US007314656B2

(12) United States Patent
Ogino et al.

(10) Patent No.: US 7,314,656 B2
(45) Date of Patent: Jan. 1, 2008

(54) RECORDING PAPER AND METHOD FOR RECORDING IMAGES USING THE SAME

(75) Inventors: Takashi Ogino, Ebina (JP); Kiyoshi Hosoi, Ebina (JP); Chizuru Koga, Ebina (JP); Tsukasa Matsuda, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 633 days.

(21) Appl. No.: 10/968,214

(22) Filed: Oct. 20, 2004

(65) Prior Publication Data

US 2005/0107254 A1 May 19, 2005

(30) Foreign Application Priority Data

| | | |
|---|---|---|
| Nov. 17, 2003 | (JP) | 2003-386592 |
| Dec. 26, 2003 | (JP) | 2003-434300 |
| Jul. 9, 2004 | (JP) | 2004-203767 |

(51) Int. Cl.
*B41M 5/50* (2006.01)

(52) U.S. Cl. ..... 428/32.11; 347/105; 428/195.1; 428/211.1; 430/118.7

(58) Field of Classification Search ..... None
See application file for complete search history.

(56) References Cited

U.S. PATENT DOCUMENTS 6,153,310 A 11/2000 Kato

FOREIGN PATENT DOCUMENTS

| | | |
|---|---|---|
| JP | A 62-144986 | 6/1987 |
| JP | A 03-038375 | 2/1991 |
| JP | A 03-038376 | 2/1991 |
| JP | A 03-199081 | 8/1991 |
| JP | A 07-276786 | 10/1995 |
| JP | A 10-046498 | 2/1998 |
| JP | A 10-278409 | 10/1998 |
| JP | A 11-115304 | 4/1999 |
| JP | B2 3127114 | 11/2000 |
| JP | B2 3172298 | 3/2001 |
| JP | A 2002-155494 | 5/2002 |
| JP | A 2002-348798 | 12/2002 |

*Primary Examiner*—Bruce H. Hess
(74) *Attorney, Agent, or Firm*—Oliff & Berridge, PLC

(57) ABSTRACT

A recording paper including a substrate which includes cellulose pulp and has a surface treated with a surface sizing solution, wherein the surface sizing solution contains a surface sizing agent and a nonionic surfactant having an HLB in a range of 6 to 13, a content of the nonionic surfactant is in a range of 1 to 100 parts by weight per 100 parts by weight of the surface sizing agent, and the surface sizing agent has a contact angle with water in a range of 40 to 75°.

20 Claims, 1 Drawing Sheet

RECORDING PAPER AND METHOD FOR RECORDING IMAGES USING THE SAME

CROSS-REFERENCE TO RELATED APPLICATION

This application claims priority under 35 USC 119 from Japanese Patent Application Nos. 2003-386592, 2003-434300 and 2004-203767, the disclosures of which are incorporated by reference herein.

BACKGROUND OF THE INVENTION

1. Field of the Invention

The present invention relates to a recording paper and a method for recording images according to an ink jet or electrophotographic recording process using the recording paper.

2. Description of the Related Art

The ink jet recording process has been attracting attention, as it has many advantages in that it allows easy full color printing, consumes less energy, is less noisy during recording, and utilizes printers having a lower production cost. Recently, while there is a trend toward further increase in image quality, speed, and reliability of the process, images and characters are more frequently printed on regular paper, and thus it is quite important to raise the recording compatibility with regular paper.

The mainstream of conventional ink jet printers includes those that employ a black ink that is lower in permeability into recording paper (hereinafter, sometimes referred to simply as "paper") and uses a pigment as a colorant and color inks that are higher in permeability into the recording paper and use dyes as colorants for improvement in the quality of black characters and for prevention of bleeding among color images (inter-color bleeding).

Accordingly, especially when images higher in recording density are printed by using color inks that are higher in permeability into paper, curl and cockle generated in the recording paper immediately after printing, leading to jamming of paper and abrasion of image portions in printers. When double-sided printing is carried out on paper, it is necessary to have periods for relaxation of the curl generated in the recording paper immediately after printing and for drying the ink during double-sided printing on paper, which results in drastic decrease in printing productivity. In addition, there is also a problem in that, when images higher in recording density are printed, the curl and cockle generated after the images are left to dry become greater, whereby the requirements of high image quality and suppression of curl and cockle cannot be satisfied at the same time at a high level.

For prevention of curl and cockle after printing, there have been proposed methods of reducing curl and cockle by relaxing the stress in paper by moisturizing a freshly prepared sheet once (e.g., Japanese Patent Application Laid-Open (JP-A) No. 3-38375), by restricting the elongation in the CD of the paper in water (e.g., JP-A No. 3-38376), by restricting the ratio of the elongations in water in the MD to CD of the paper to 1.3 or less (e.g., JP-A No. 3-199081), by restricting the elongation in water in the moving direction of a portion on which ink is ejected to 2.0% or less (e.g., JP-A No. 7-276786), and by restricting the elongation in water in the CD to 1.8% or less (e.g., JP-A No. 10-46498), as well as a method of reducing cockle of a coated-type ink jet recording sheet by adjusting the amount of pigments contained in a support to 5 to 35% by weight and the internal bonding strength of the recording sheets (recording papers) to 150 to 455 g/cm (e.g., Japanese Patent No. 3172298), and the like.

Although the curl and cockle have been reported to be reduced by the methods described in JP-A Nos. 3-38375, 3-38376, 3-199081, 7-276786, and 10-46498, when ink that is rapidly permeable into recording paper is used, and the amount of the ink ejected is large, or when the printing speed is fast and the ink quantity ejected per unit of time is large, the curl becomes significantly larger and the paper is practically unusable as a document.

Alternatively, a method for reducing swelling after printing by controlling the internal bonding strength of a recording paper having an ink receiving layer to within a particular range has been described in Japanese Patent No. 3172298, but it is not sufficiently effective to prevent curl, cockle, and swelling of the paper only by adjusting the internal bonding strength. Especially when ink that is rapidly permeable into recording paper is used and the amount of the ink ejected is large, i.e., when the printing speed is fast and the ink quantity ejected per unit of time is large, the resulting paper is practically unusable as a document as it has greater cockle.

In addition, a method of reducing curl and cockle generated after paper is left to dry by controlling the irreversible shrinkage of the paper in the MD and CD caused when the relative humidity of the environment is changed to within a particular range is proposed (e.g., Japanese Patent No. 3127114). However, if the ink penetration into the recording paper is not suppressed, such a paper is not sufficiently advantageous, because when a rapidly permeable ink is used and the amount of the ink ejected is larger, the ink penetrates deep into the recording paper, increasing the absolute amount of fibers that shrink after drying overall and increasing the curl after the paper is left to dry.

Alternatively, a method of adding an ester-based nonionic surfactant having an HLB of 11 or more into an ink receiving layer has been proposed for improvement in image quality (e.g., JP-A No. 10-278409), but the ester-based nonionic surfactant having an HLB of 11 or more is too hydrophilic to cover the hydrophilic groups on a substrate (base paper) with hydrophobic groups of the surfactant, and when the ink quantity is great, the recording paper becomes more vulnerable to deformation, whereby curl becomes greater and the recording paper becomes unusable as a document.

A method of adding a surfactant having an HLB in the range of 3 to 12 to an ink receiving layer on a film surface has also been proposed for improvement in image quality (e.g., JP-A No. 62-144986), but even if the method is applied to regular paper, it is difficult to cover the hydrophilic groups of a substrate with hydrophobic groups of the surfactant since the addition amount is as low as less than 0.1% by weight, and especially when ink that is rapidly permeable into recording paper is ejected in a greater amount, i.e., when the printing speed is fast and the ink quantity ejected per unit of time is large, the paper exhibits greater cockle and is not usable as a document.

A method of size pressing using an oxidized starch obtained by a dry process has been proposed for prevention of curl (e.g., JP-A No. 2002-348798), but if this technique is used alone, elongation of the substrate due to water in the ink is great when the ink is ejected in a greater amount, and thus the resulting paper cannot be used as a document since the curl thereof is increased.

Alternatively, an ink receiving layer containing a silanol-modified polyvinyl alcohol (PVA), 11 to 20% by weight of a nonionic surfactant, and a synthetic amorphous silica as a filler has been proposed for improvement in image quality in an ink jet recording process (e.g., JP-A No. 11-115304). However, the HLB of the surfactant used is not specifically described in this patent application, and the HLB of the surfactant used in an example is 14. Thus the surfactant is too hydrophilic to cover the hydrophilic groups of a substrate with hydrophobic groups of the surfactant when it is applied to paper made from a cellulose pulp. Moreover, with this technique alone, elongation of the substrate due to water in the ink is similarly great, and thus the paper is not usable as a document since the curl thereof is increased.

Further, a method of adding a bulking softener having an HLB of 6 or less has been proposed for improvement in the bulkiness and softness of printing papers, but a surfactant having an HLB of 6 or less, and in particular an HLB of 4 or less, is not advantageous as it is less dispersible and cannot cover the hydrophilic groups in a substrate with hydrophobic groups of the surfactant, resulting in an increase in the amount of fibers that are elongated and shrunk and thus in an increase in curl (e.g., JP-A No. 2002-155494).

SUMMARY OF THE INVENTION

The present invention has been made in view of the above circumstances.

The invention provides a recording paper that can be used both in ink jet and electrophotographic recording processes, which enables printing on both faces of a paper by suppressing generation of curl and cockle in the paper immediately after printing, suppresses generation of curl and cockle after the paper has been left to dry, and reduces unevenness of images, when images are printed in the ink jet recording process, and which enables printing on both faces of a paper by suppressing generation of curl and cockle in the paper immediately after printing without improper transfer of images, and suppresses generation of curl and cockle after the paper has been left to dry, when images are printed in the electrophotographic process; and an image recording method using the same.

The present inventors have carried out intensive study concerning a method for suppressing curl and cockle in a regular paper generated immediately after printing to thus make the paper suitable for double-sided printing, and for suppressing curl and cockle in the paper generated after the paper is left to dry.

As a result, the curl and cockle generated immediately after printing have been found to be generated, for example, by rapid expansion in the size of a fiber layer that has absorbed water contained in an aqueous ink, and the curl and cockle generated after the paper is left to dry have been found to be generated by shrinkage of the fiber layer that has absorbed the ink caused by dehumidification. In addition, the curl and cockle after the paper is left to dry have been found to be increased as the ink penetration in the thickness direction of paper over a very short time period becomes faster and deeper.

From these results, the inventors have studied intensively the influence of water absorption and desorption on the transmissibility of elongation and shrinkage of ink-absorbed fiber layers. As a result, they have found that the transmissibility of elongation and shrinkage caused by absorption and desorption of water has a close relationship with the elongation and shrinkage rate of the paper, and that it is possible to decrease the curl and cockle generated immediately after printing and the curl and cockle generated after the paper is left to dry by reducing the transmissibility of elongation and shrinkage by controlling the elongation and shrinkage rate of the paper. Moreover, it has been found that presence of a surfactant having an HLB in a particular range on the paper inhibits hydrogen bond formation, suppresses the elongation and shrinkage rate, and thus reduces the curl and cockle of the paper.

Further, it has been found that when a paper is processed with a surface sizing agent which is an essential component of paper, and especially when the paper is treated with a surface sizing agent that contains a hydrophobic surface sizing agent having a contact angle with water of a particular value or more in an amount of 5% by weight or more relative to a total amount of surface sizing agents, the surface sizing agent becomes less likely to suppress the surfactant's effect of reducing dimensional change, consequently leading to decrease in the curl and cockle generated immediately after printing and the curl and cockle generated after the paper is left to dry.

After intensive studies on the applicability to electrophotographic and ink jet recording processes, it has been confirmed that when a base paper having a sizing degree of a particular value or more is treated with a surfactant for reduction of curl, there are incidences of improper image transfers in the electrophotographic process, depending on the kind of the surfactant used.

Therefore, the inventors have studied the relationship between the kinds of surfactants and the image transferability in the electrophotographic process, focusing on the structure of surfactants. The results have revealed that there is a close relationship between the position of the hydrophilic group in the surfactant molecule and the inadequate image transfer in the electrophotographic process, and that it is possible to avoid the improper image transfer in the electrophotographic process, to reduce the curl when images are printed in the ink jet process, and to make the processed paper compatible with both electrophotographic and ink jet processes by using an ester-based nonionic surfactant containing hydrophilic groups of the surfactant dispersed in the molecule. Particularly when the surfactant and the surface sizing agent are used in combination, the surfactant becomes dispersed more uniformly in the paper, further improving the image-transferring efficiency in the electrophotographic process due to the particular structure of the surfactant. The invention has been accomplished based on the discovery of this novel effect.

Further, it has been found that, by using a polyvinyl alcohol as the surface sizing agent having a contact angle with water in the range of 40 to 75° and by further reducing the polymerization degree thereof, the dispersibility of the surfactant can be improved, the image-transferring efficiency in the electrophotographic process can be improved, and unevenness of images in the ink jet process can be prevented. In such a case, it is possible to increase the image-transferring efficiency in the electrophotographic process and suppress the curl in the ink jet process drastically, by specifying the saponification value of the polyvinyl alcohol so that the polyvinyl alcohol becomes more hydrophobic.

The permeability of the surface sizing solution has been also investigated, and the Stockigt sizing degree of paper processed with a surface sizing solution containing a nonionic surfactant has been also intensively studied. As a result, it has been found that there is a close relationship between the sizing degree and the problems in various image-outputting processes. When the Stockigt sizing degree is longer than 30 seconds, the surfactant is not distributed in the paper uniformly, causing not only reduction in the curl-preventing effect but also unevenness of image transfer due to change in local electric properties. Furthermore, when the Stockigt sizing degree is shorter than 1 second, the sizing efficiency becomes lower, leading to drastically worsened ink bleeding, feathering, and offset in the ink jet recording process. It has been confirmed that adjustment of the Stockigt sizing degree to within the range of 1 to 30 seconds allows reduction of curl, eliminates problems in image quality such as feathering, offset, and the like in the ink jet process, and also eliminates improper image transfer in the electrophotographic process.

Additionally, the formation of the paper, which serves as an indicator of the uniformity of fibers in paper, has been also examined, and the relationships between the range of the formation index, and generation of curl in the ink jet process and image-transferring efficiency in the electrophotographic process have been also investigated. As a result, it has been found that there is a close relationship between the formation index and problems in various image-outputting processes. Specifically, when the formation index is less than 10, a surfactant tends to be less uniformly distributed in the paper due to the unevenness in paper formation, causing unevenness of image transfer in the electrophotographic process. Alternatively, if the formation index is larger than 50, it may become necessary to beat the paper once again for ensuring the uniformity of the paper, which results in increased curl in the ink jet process.

It has been also found that in the ink jet recording process, presence of a cationic material (e.g., a polyvalent metal salt or a cationic resin), which has a polarity opposite to that of the ink or ink dispersant, in paper is effective in improving coloring which is reduced by the nonionic surfactant added for prevention of curl. The electric resistance properties of paper are also important for ensuring image transferability in the electrophotographic process. Since a surfactant and a cationic material that may cause change in electric properties are used in the invention, a particular range that allows reliable image transfer has been identified by intensively examining the range for ensuring favorable image transferability in the electrophotographic process, and as a result, a recording paper that can be used both in electrophotographic and ink jet processes has been identified.

A first aspect of the invention is to provide a recording paper comprising a substrate which comprises cellulose pulp, the substrate having a surface treated with a surface sizing solution, wherein the surface sizing solution contains a surface sizing agent and a nonionic surfactant having an HLB in a range of 6 to 13; a content of the nonionic surfactant is in a range of 1 to 100 parts by weight per 100 parts by weight of the surface sizing agent; and the surface sizing agent has a contact angle with water in a range of 40 to 75°.

A second aspect of the invention is to provide an image recording method using an ink jet recording process comprising ejecting an ink droplet onto a recording paper to record an image on a surface thereof, wherein the recording paper is the recording paper according to the first aspect of the invention.

A third aspect of the invention is to provide an image recording method using an electrophotographic process comprising charging an electrostatic latent image holding member surface, exposing the electrostatic latent image holding member surface to light to form an electrostatic latent image thereon, developing the electrostatic latent image formed on the electrostatic latent image holding member surface by using a developer to form a toner image, transferring the toner image onto a surface of a recording paper, and fixing the toner image thereon, wherein the recording paper is the recording paper according to the first aspect of the invention.

Further, the inventors of the invention have found from the results of the studies on the transmissibility of elongation and shrinkage caused by absorption and desorption of water by the ink-absorbed fiber layer that it is possible to reduce dimensional change and consequently reduce the curl and cockle generated immediately after printing and the curl and cockle generated after the paper is left to dry, by applying a nonionic surfactant having an HLB of 6 to 13 to the paper.

They have also found that, when a paper surface is processed with a surface sizing solution including a surface sizing agent as an essential component, it is possible, by adding a nonionic surfactant having the functions described above and a cationic surfactant together with the surface sizing agent, to prevent the surface sizing agent from inhibiting the nonionic surfactant's effect of reducing dimensional change due to the preferential absorption of the cationic surfactant on the surface sizing agent, and consequently to reduce the curl and cockle generated immediately after printing and the curl and cockle generated after the paper is left to dry.

DETAILED DESCRIPTION OF THE INVENTION

Figure 1:
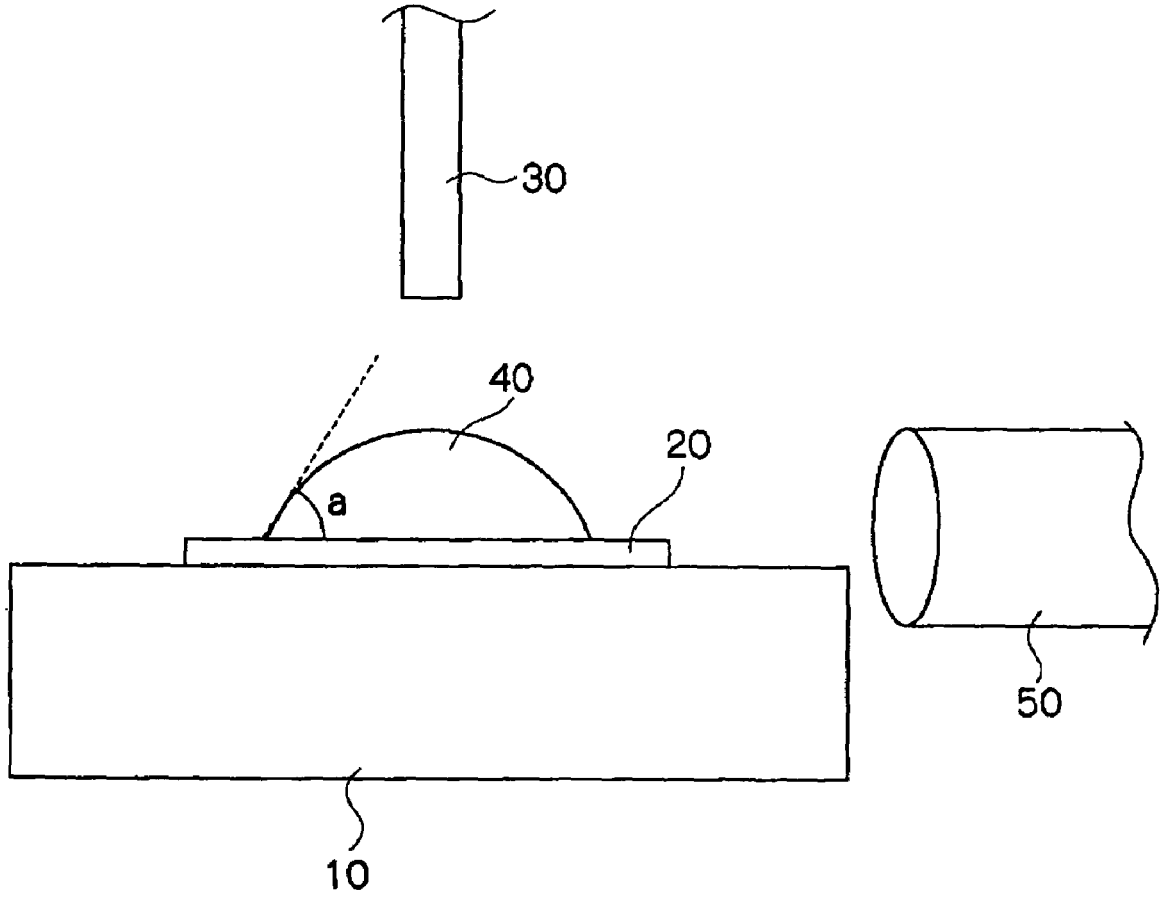
FIG. 1 is a schematic view illustrating a state in which a contact angle with water is measured according to the present invention.

Hereinafter, the present invention will be described in detail, separately as a recording paper and as an image recording method.

<Recording Paper>

The recording papers according to the invention are described in detail by grossly dividing into the first and second recording papers.

(First Recording Paper)

The first recording paper according to the invention will be described hereinafter.

The recording paper according to the invention is a recording paper including a substrate which includes cellulose pulp and has a surface treated with a surface sizing solution, wherein the surface sizing solution contains a surface sizing agent and a nonionic surfactant having an HLB in a range of 6 to 13, a content of the nonionic surfactant is in a range of 1 to 100 parts per 100 parts by weight of the surface sizing agent, and the surface sizing agent has a contact angle with water in a range of 40 to 75°. In an embodiment, the surface sizing solution contains the surface sizing agent having a contact angle with water in a range of 40 to 75° in an amount of 5% by weight or more relative to the total amount of surface sizing agents.

When images are printed by the ink jet recording process, the recording paper according to the invention (1) enables printing of the images on both faces of paper by suppressing generation of the curl and cockle immediately after printing, (2) suppresses the curl and cockle after the recording paper is left to dry, and (3) suppresses the unevenness in image portions and thus improves the density thereof.

Further, it also (4) suppresses generation of the curl and cockle after the recording paper is left to dry, and (5)

suppresses generation of unevenness of image transfer during image transfer, when images are printed by the electrophotographic process.

In contrast, conventional recording papers used in ink jet recording and electrophotographic processes, which are not surface-treated with a surfactant or if surface-treated, processed commonly with a surfactant having an HLB of more than 13 in an amount of 0.01 g/m$^2$ or less, and thus have not been able to reduce the curl compared to the recording paper according to the invention.

As described above, for reduction of the curl and cockle of the recording paper after ink printing, it is effective to cover the hydrophilic groups in substrate (base paper) with the hydrophobic group of the surfactant. On the other hand, during production of paper, a pigment such as calcium carbonate and a surface sizing agent for making the pigment retained on the substrate are commonly used for improving the whiteness of paper, but when the surfactant and the surface sizing agent are used together, the advantageous effects described above have not been obtained, since the surface sizing agent inhibits the surfactant's coating on cellulose in the substrate and impairs the effect of reducing dimensional change provided by the surfactant.

After intensive studies, the inventors have found that it is possible to treat the surface of paper with a nonionic surfactant uniformly and reliably by using a the surface sizing solution containing a nonionic surfactant having a particular hydrophobicity, i.e., having an HLB in the range of 6 to 13, not alone but with a surface sizing agent.

The inventors have found that in particular, combined use of a surface sizing agent having a hydrophobicity higher than common surface sizing agents, i.e., having a contact angle with water in the range of 40 to 75° as the surface sizing agent and a nonionic surfactant having an HLB in the range of 6 to 13 allows penetration of the surfactant into the substrate without inhibition by the surface sizing agent and prevents the generation of curl after printing and after the paper is left to dry more effectively.

The surface sizing agent has a contact angle with water in the range of 40 to 75°, preferably in the range of 45 to 60°, and more preferably in the range of 50 to 60°.

If the contact angle with water is less than 40°, the surface sizing agent becomes more hydrophilic, inhibiting the surfactant's coating on cellulose in the substrate, impairing the effect of reducing dimensional change provided by the surfactant, and consequently leading to increase the curl and cockle immediately after printing and after the recording paper is left to dry. On the other hand, if the contact angle with water is more than 75°, the paper becomes more water repellent, reducing penetration of the ink and causing problems in image quality such as the bleeding at the boundary between different color images (inter-color bleeding) and the like during ink jet recording.

Method for measuring the contact angle of the surface sizing agent with water according to the invention will be described with reference to FIG. 1.

FIG. 1 is a schematic view illustrating a way of measuring the contact angle with water. For preparation of a test sample, 1 ml of an aqueous solution containing a surface sizing agent in an amount of 10% by weight is first dropped on the surface of a glass plate 10 and dried in a dryer at 105° C. until water is completely evaporated, to form a surface sizing agent film layer 20 on the glass plate 10 surface.

Then, approximately 2 μl of distilled water is dropped by a microsyringe 30 onto the surface sizing agent film layer 20 on the glass plate 10 surface, and the contact angle a between a droplet 40 of distilled water and the surface sizing agent film layer 20 after 10 seconds is determined from the image obtained by a CCD camera 50, and designated as the "contact angle with water".

More specifically, the contact angle is determined in an environment of 23° C. and 50% RH by using a contact angle analyzer, CA-X (trade name), manufactured by Kyowa Interface Science Co., Ltd. A higher contact angle indicates that the surface sizing agent is less hydrophilic, and a lower contact angle more hydrophilic.

For obtaining a surface sizing agent having a contact angle with water of a particular value or more according to the invention, it is necessary to raise the hydrophobicity of the surface sizing agent and thus, for example, modify the hydrophilic group (hydroxyl group) of the surface sizing agent by acetylation, phosphoesterification, or the like, to convert thereof to a hydrophobic group. Alternatively, it is possible to make the surface sizing agent more hydrophobic by increasing the crystallinity thereof and forming a structure more resistant to penetration of water.

Typically, among many surface sizing agents, acetylated starches, phosphoesterified starches, and the like improved in hydrophobicity are more preferably as the surface sizing agent according to the invention instead of commonly used oxidized starches. In addition, polyvinyl alcohols having a lower saponification value, which retains many hydrophobic groups or those having an extremely higher saponification value and thus improved in hydrophobicity, may also be used favorably. Further, silanol-modified surface sizing agents improved in hydrophobicity or the like may also be used.

These agents may be used alone or in combination, and are not limited to the agents described above, if they have a "contact angle with water" in the preferable range.

On the other hand, the HLB of the nonionic surfactant according to the invention (hereinafter, sometimes referred to simply as "surfactant") is required to be in the range of 6 to 13, is preferably in the range of 6 to 11, and is more preferably in the range of 7 to 9.

If the HLB is over 13, the surfactant becomes more hydrophilic, and the effectiveness of the surfactant at coating cellulose in the substrate and reducing dimensional change of the recording paper is lowered, consequently leading to increase in the curl and cockle immediately after printing and after the recording paper is left to dry. If the HLB is less than 6, the surfactant becomes less dispersible, cannot be uniformly present on the paper, and is less effective at reducing dimensional change, thereby increasing the curl and cockle immediately after printing and after the recording paper is left to dry.

Examples of the nonionic surfactants for use in the invention include polyoxyethylene nonylphenylether, polyoxyethylene octylphenylether, polyoxyethylene dodecylphenylether, polyoxyethylene alkylethers, polyoxyethylene fatty acid esters, sorbitan acid fatty esters, acetylene glycol ethylene oxide adducts, polyoxyethylene sorbitan fatty acid esters, fatty acid alkylol amides, polyethylene glycol-polypropylene glycol block copolymers, polyoxyethylene ethers of glycerin esters, polyoxyethylene ethers of sorbitol ester, and the like.

Among them, the acetylene glycol ethylene oxide adducts and the ester-based compounds are preferably used.

In the invention, the content of the surfactant in the surface sizing solution is required to be in the range of 1 to 100 parts per 100 parts by weight of the surface sizing agent. The content of surfactant is preferably in the range of 1 to 20 parts by weight and more preferably in the range of 5 to 10 parts by weight, per 100 parts by weight of the surface sizing agent.

If the content of surfactant is less than 1 part by weight, the surfactant's effect of coating the cellulose in the substrate becomes smaller and the effefct of reducing dimensional change of the recording paper provided by the surfactant is reduced, thereby increasing the curl and cockle. If it is more than 100 parts by weight, too much presence of the surfactant may cause the problems such as inter-color bleeding and the like.

As described above, when a surface sizing agent and a surfactant are used together, if the surfactant is not present at a particular amount or more, the surfactant is not effective in reducing dimensional change and in reducing the curl. In particular, conventional common-use papers both for ink jet and electrophotographic processes, which are commonly not added with a surfactant or added with a surfactant having an HLB of over 11 in an amount of 0.01 g/m$^2$ or less, have not been able to reduce the curl.

Even when added, the surfactant occasionally caused unevenness during image transfer in the electrophotographic process, depending on the combination of the kind of the surfactant and the Stockigt sizing degree thereof.

After intensive studies, the inventors have found that application of a nonionic surfactant having a particular hydrophobicity, i.e., an HLB of 6 or more and less than 11, which is narrower than the above preferable HLB range of surfactant, in an amount in the range of 0.02 to 1.0 g/m$^2$ on paper can lead to further reduction of the curl. It has been also found that it is possible to reduce the curl, and particularly to suppress generation of unevenness during image transfer in the electrophotographic process, by using an ester-based nonionic surfactant as the surfactant and adjusting the Stockigt sizing degree of paper in the range of 1 to 30 seconds.

Specifically, the paper is surface-treated with a surface sizing solution containing a nonionic surfactant having a particular hydrophobicity and having an HLB of 6 or more and less than 11, and surface sizing agents including a surface sizing agent having a contact angle with water in the range of 40 to 75° in an amount of 5% by weight or more, so that the paper is provided with the surfactant in an amount in the range of 0.02 to 1.0 g/m$^2$.

Here, the term "the paper is provided with the surfactant" means that during production of the recording paper, the materials having the above-mentioned properties are included by carrying out the surface treatment, and the surfactant is adhered and bound among pulp fibers on the surface of and/or in the recording paper. Addition of a particular surfactant in this manner allows inhibition of the binding among fibers as described above.

Since a nonionic surfactant having an HLB of 6 or more and less than 11 exhibits hydrophobicity, a surface sizing agent having a contact angle with water that is not in the range of 40 to 75° can be contained in the surface sizing solution, which in turn improves the hydrophobicity of the paper after surface treatment.

If a surface sizing agent having a contact angle with water in the range of 40 to 75° and another surface sizing agent not in the range are used in combination, it is preferably to use the surface sizing agent having a contact angle with water in the range of 40 to 75° in an amount of 5% or more, and more preferably 20% by weight or more.

In such a case, the nonionic surfactant is preferably an ester-based surfactant. If the surfactant is not an ester-based nonionic surfactant, although it is possible to cover the hydroxyl groups on paper with the surfactant and reduce the curl thereof, the hydrophobic groups of the surfactant are exposed on the paper surface, occasionally changing the electric properties of the paper locally and causing unevenness of image transfer. In contrast, an ester-based nonionic surfactant, which contains hydrophilic groups in the molecule, provides the paper surface with hydrophilic groups of the surfactant even when the hydroxyl groups on paper are covered with the surfactant, thus preventing local change in electric properties of the paper or the unevenness of image transfer.

The favorable ester-based nonionic surfactants include, but are not limited to, for example, sorbitan fatty acid esters, glycerin monofatty acid esters, polyoxyethylene hydrogenated castor oil fatty acid esters, polyglycerin fatty acid ester, and the like.

Among them, sorbitan fatty acid esters and polyglycerin fatty acid esters are particularly preferable.

The advantageous effects of the particular ester-based nonionic surfactant are obtained when the amount of the surfactant provided after the treatment with the surface sizing solution containing a surface sizing agent and a surfactant is in the range of 0.02 to 1.0 g/m$^2$. The amount of the surfactant provided is preferably in the range of 0.02 to 0.8 g/m$^2$ and more preferably in the range of 0.05 to 0.4 g/m$^2$.

If the amount of the surfactant provided is less than 0.02 g/m$^2$, the surfactant's effect of coating the cellulose in the substrate becomes smaller, and the effect of reducing dimensional change of the recording paper provided by the surfactant is reduced, thereby increasing the curl and cockle. Alternatively, if it is over 1.0 g/m$^2$, the amount of the surfactant becomes excessive, leading to problems in image quality such as inter-color bleeding, offset, and the like.

As described above, the Stockigt sizing degree of the paper is preferably in the range of 1 to 30 seconds, more preferably in the range of 2 to 25 seconds, and still more preferably in the range of 2 to 20 seconds.

If the Stockigt sizing degree is longer than 30 seconds, the surfactant may not be dispersed uniformly on paper, leading not only to lowered curl-preventing effect but also to local change in electric properties of the paper and unevenness of image transfer. If the Stockigt sizing degree is shorter than 1 seconds, the paper is not well sized, occasionally resulting in drastic increase in ink bleeding, feathering, and offset in the ink jet recording process.

The Stockigt sizing degree in the invention is a Stockigt sizing degree determined according to JIS P8122, and the Stockigt sizing degree in the invention is defined as a value for a sheet having a basis weight 70 g/m$^2$, and thus the Stockigt sizing degree of papers different in basis weight is converted to that of the standard paper based on the Lucas-Washburn formula, i.e., according to the following formula:

$$\text{Stockigt sizing degree (sec)} = \text{Stockigt sizing degree} \times (70/\text{basis weight of the tested paper})^2.$$

Polyvinyl alcohol is preferably used as the surface sizing agent having a contact angle with water in the range of 40 to 75°, when an ester-based nonionic surfactant is used.

In such a case, by reducing the polymerization degree of the polyvinyl alcohol used, the surfactant can uniformly function on paper, whereby the curl can be reduced and the image transferability in the electronic photographic process can be improved. In addition, such surfactants make the paper surface more uniform and thus suppress unevenness in images and increase density of the images in the ink jet process.

Specifically, the polymerization degree of polyvinyl alcohol is preferably in the range of 100 to 1,500, more preferably in the range of 200 to 1,000, and still more preferably in the range of 200 to 500. If the polymerization degree is larger than 1,500, polyvinyl alcohol may become higher in coating property and impair uniform dispersion of the surfactant. On the contrary, if the polymerization degree is less than 100, the polyvinyl alcohol becomes drastically lower in coating property, causing generation of paper powders and the mechanical troubles associated therewith when images are printed on paper in an electrophotographic printer or the like.

The polyvinyl alcohol is preferably one whose saponification value is made very low to leave hydrophobic groups, or one whose saponification value is made very high to improve crystallinity and raise hydrophobicity. Specifically, polyvinyl alcohol has a greater hydrophobicity when it has a saponification value of 98 or more, or 35 or more and less than 80, and can reduce the curl in the ink jet recording process and additionally secures favorable image transferability in the electrophotographic process. If the saponification value is 80 or more and less than 98, polyvinyl alcohol becomes more hydrophilic and may become less effective in reducing the curl and securing the favorable image transferability in the electrophotographic process. If the saponification value is less than 35, the polyvinyl alcohol become too hydrophobic and occasionally cannot be contained in a surface sizing solution, as it is not dispersible or soluble in water.

The recording paper according to the invention contains at least cellulose pulp as the raw material, and is obtained by surface-treating the following substrate with a surface sizing solution containing the surface sizing agent and the nonionic surfactant described above.

The substrate contains at least cellulose pulp as the raw material, and may be the following base paper or a regular paper prepared by treatment of the surface of the base paper with a pigment, binder, or the like.

The base paper contains a cellulose pulp, and any known cellulose pulps may be used as the cellulose pulp, and examples thereof include chemical pulps such as bleached hardwood Kraft pulp, unbleached hardwood Kraft pulp, bleached softwood Kraft pulp, unbleached softwood Kraft pulp, bleached hardwood sulfite pulp, unbleached hardwood sulfite pulp, bleached softwood sulfite pulp, and unbleached softwood sulfite pulp; pulps prepared by chemical processing of fibrous materials such as wood, cotton, hemp, and soft leather; and the like.

In addition, groundwood pulps mechanically pulped from woods and chips, chemimechanical pulps mechanically pulped from woods and chips previously impregnated with chemicals, thermomechanical pulps pulped in refiner after chips are steamed until they become slightly softer, and the like may also be used. These pulps may be prepared only from a virgin pulp or in combination with a recycled pulp if necessary.

In particular, the virgin pulp is preferably an elementally chlorine free (ECF) pulp bleached without use of chlorine gas but by chlorine dioxide, or a total chlorine free (TCF) pulp bleached mainly by ozone/hydrogen peroxide or the like without use of any chlorine compounds.

Raw materials for the recycled pulps include unprinted waste papers of extremely high quality, high quality, and medium-grade, low-grade, and other white papers that are cut, damaged, and irregular in size; high quality waste papers such as woodfree and coated woodfree papers that are printed or copied; waste papers printed with inks such as aqueous and oil-based inks or with lead pencils; newspaper waste papers containing advertising leaflets such as printed woodfree paper, woodfree coated paper, wood-containing paper, and wood-containing coated paper; and waste papers of wood-containing papers, coated wood-containing papers, wood papers, and the like, generated in bookmakers, print shops, cutting facilities, and the like.

The recycled pulps used for base papers according to the invention are preferably the pulps of raw waste papers bleached at least either by an ozone or hydrogen peroxide bleaching treatment. For obtaining recording papers higher in whiteness, it is preferable to make a blending ratio of the waste papers obtained by the bleaching treatment above in the range of 50 to 100%. Further from the viewpoint of resource recycling, the blending ratio of the recycled pulps above is preferably in the range of 70 to 100%.

The ozone treatment described above decomposes fluorescence dyes and the like that are commonly contained in woodfree papers, while the hydrogen peroxide bleaching treatment prevents yellowing caused by the alkalis used in deinking process. In particular, combined use of these two treatments allows easier deinking of waste papers and at the same time improves the whiteness of the pulps obtained. In addition, the treatment also decomposes and eliminates the chlorine compounds remaining in the pulps and thus is very effective in reducing the content of organic halogen compounds in the waste papers that are bleached with chlorine.

In addition, a filler is preferably added to the base paper of the invention for adjustment of the opacity, whiteness, and surface smoothness thereof. It is preferably to use a non-halogen filler particularly when reduction in the halogen content of recording papers is preferable. Examples of the fillers for use include white inorganic pigments such as heavy calcium carbonate, light calcium carbonate, chalk, kaolin, calcined clay, talc, calcium sulfate, barium sulfate, titanium dioxide, zinc oxide, zinc sulfide, zinc arbonate, aluminum silicate, calcium silicate, magnesium silicate, synthetic silica, aluminum hydroxide, alumina, sericite, white carbon, saponite, calcium monmorillonite, sodium monmorillonite, and bentonite; organic pigments such as acrylic plastic pigments, polyethylene, urea resins; and the like. If waste paper is blended, the blending amount of the waste paper is required to be determined by previously estimating the ashes contained in the raw waste-paper.

Further, an internal sizing agent is preferably added to the base paper for use in the invention, and examples of the internal sizing agents include those used in neutral sheeting processes such as neutral rosin-based sizing agents, alkenylsuccinic anhydrides (ASAs), alkylketene dimers (AKDs), and petroleum resin-based sizing agents.

Alternatively, when the surface of recording paper is adjusted to be cationic, the surface can be treated with a cationic substance, for example, a hydrophilic cation resin or the like, and the sizing degree of the paper before application of the cationic resin is preferably 10 seconds or more and less than 60 seconds for suppression of penetration of this cationic resin into the paper.

The recording paper according to the invention is obtained after the base paper described above is surface-treated with a surface sizing solution containing the surface sizing agent and the nonionic surfactant described above.

The surface sizing solution contains a solvent such as water as the major component, and the concentration of the surface sizing agent and the nonionic surfactant contained therein is preferably in the range of 1 to 10% by weight and more preferably in the range of 3 to 7% by weight.

The amount of the surface sizing solution used is preferably in the range of 0.1 to 2.0 g/m$^2$ and more preferably in the range of 1.0 to 2.0 g/m$^2$ on one face of recording paper.

If the amount used is more than 2 g/m$^2$, the absolute amount of the surface sizing agent provided becomes larger, occasionally preventing the curl-preventing effect by the surfactant and increasing the curl and cockle. Alternatively, if it is less than 0.1 g/m$^2$, the absolute amount of the surface sizing agent becomes smaller, and it may become difficult to fix a pigment, which is applied together with the surface sizing agent, on the paper surface, generating a greater amount of paper powders and causing mechanical troubles when the recording papers are supplied into a copying machine or the like.

The surface treatment may be carried out by coating a surface sizing solution by using a coating means commonly used in the art such as a size press, shim size, gate roll, roll coater, bar coater, air knife coater, rod blade coater, or blade coater. The recording paper according to the invention can be obtained after drying in a subsequent drying step.

The basis weight of the recording paper according to the invention is not particularly limited, but preferably in the range of 60 to 128 g/m$^2$, more preferably in the range of 60 to 100 g/m$^2$, and still more preferably in the range of 60 to 90 g/m$^2$. A larger basis weight is advantageous for preventing the curl and cockle, but if the basis weight is more than 128 g/m$^2$, the paper becomes too rigid, occasionally leading to decrease in the paper-traveling speed in printer. Alternatively, if it is lower than 60 g/m$^2$, it becomes sometimes more difficult to suppress generation of the curl and cockle, and such papers are unfavorable from the viewpoint of offset.

It is also preferable to control the fiber orientation ratio in the range of 1.0 to 1.55, preferably in the range of 1.0 to 1.45, and still more preferably in the range of 1.0 to 1.35 during paper making. Proper control of the fiber orientation ratio in this manner allows decrease in of the curl of papers (recording papers) after printed in the ink jet process. The fiber orientation ratio is a value determined by ultrasonic transmission velocity method, i.e., a value calculated by dividing the ultrasonic transmission velocity in the MD (the traveling direction of the paper in paper machine) of the recording paper by that in the CD (the direction orthogonal to the MD), as defined in the following Formula: (Fiber orientation ratio of base paper (T/Y ratio) as determined by ultrasonic transmission velocity method)=(Ultrasonic transmission velocity in MD)÷(Ultrasonic transmission velocity in CD).

The fiber orientation ratio by the ultrasonic transmission velocity method is determined by using the Sonic Sheet Tester (trade name) manufactured by Nomura Shoji.

The recording paper according to the invention preferably contains a cationic resin and/or a polyvalent metal salt on the surface, and if the surface of recording paper contains a cationic resin or a polyvalent metal salt and the ink jet ink contains an anionic polymer, cross-linking between these ingredients allows extremely fast coagulation of colorants, provides images excellent in printing quality, and suppresses penetration of the ink solvent into paper, which in turn prevents generation of the curl and cockle immediately after printing and after the recording paper is left to dry.

Examples of the polyvalent metal salts include chloride, sulfate, nitrate, formate, acetate, and other salts of potassium, barium, calcium, magnesium, zinc, tin, manganese, aluminum, and other polyvalent metals, and specific examples thereof include barium chloride, calcium chloride, calcium acetate, calcium nitrate, calcium formate, magnesium chloride, manganese sulfate, magnesium nitrate, magnesium acetate, magnesium formate, zinc chloride, zinc sulfate, zinc nitrate, zinc formate, tin chloride, tin nitrate, manganese chloride, manganese sulfate, manganese nitrate, manganese formate, aluminum sulfate, aluminum nitrate, aluminum chloride, aluminum acetate, and the like. These salts may be used alone or in combination of two or more. Among these polyvalent metal salts, preferable are metal salts higher in solubility in water and higher in ionic valency. Further, as use of a strong acid as the counter ion of the polyvalent metal salt often leads to yellowing of paper after application, the metal salts are preferably calcium chloride, calcium formate, magnesium chloride, magnesium formate, and the like.

Examples of the cationic resins include, but are not limited to, cationic cellulose, cationic starch, cationic starch, and the like.

The cationic resins and the polyvalent metal salts listed above can be applied on the surface of recording papers by blending them in a surface sizing solution or by preparing a separate coating solution containing the same. In the latter case, the coating solution obtained by dissolving them in water may be directly applied onto a recording paper (or paper), but is usually blended with a binder before use.

The amount of the cationic resin and the polyvalent metal salt contained on recording paper surface is preferably in the range of 0.1 to 2 g/m$^2$ and more preferably in the range of 0.5 to 1 g/m$^2$.

If the content is less than 0.1 g/m$^2$, the reaction with the pigment or the anionic polymer in ink is weakened, consequently leading to deterioration in image quality and increase in the curl and cockle immediately after printing and the curl and cockle after the recording paper is left to dry. Alternatively, if the content is more than 2 g/m$^2$, the ink may become less permeable, causing deterioration in ink drying characteristics at the time of high-speed printing.

The formation index of the recording paper according to the invention is preferably in the range of 10 to 50 and more preferably in the range of 20 to 40. If the formation index is less than 10, a surfactant is less uniformly distributed on the surface of a paper due to the unevenness in paper formation, causing unevenness of image transfer in the electrophotographic process. Alternatively, if the formation index is larger than 50, it becomes necessary to beat the paper once again for ensuring the uniformity of the paper, which increases the curl in the ink jet process.

Here, the formation index is a value determined by using a 3D sheet analyzer (trade name: M/K950, manufactured by M/K Systems, Inc.) with an aperture of 1.5 mm in diameter and by analyzing with the Formation Tester (MFT) (trade name, manufactured by M/K Systems, Inc.).

Specifically, a sample is placed on the rotating drum in the 3D sheet analyzer, and the local variation in basis weight of the sample is determined from the variation in light intensity, by using a light source connected to the shaft of drum and a photodetector that is placed at a place corresponding to the light source outside the drum. The area to be analyzed during measurement is controlled by the diameter of the aperture fixed at the inlet portion of the photodetector. Subsequently, the variations in light intensity (deviation) are amplified, A/D-converted, and classified into 64 optically determined basis-weight groups. A million pieces of data are collected by a single scan and are used for obtaining a histogram of the frequency for each group. The formation index is a value calculated by dividing the maximum frequency (peak value) in the histogram by the number of the groups having a frequency of 100 or more among the 64 groups classified according to the respective slightly different basis weights and further multiplying the resulting value by 1/100. The greater the formation index is, the better the formation is.

Electric properties of paper are also important when the recording paper is used for image recording using the electrophotographic process, and especially in the invention employing many surfactants and cationic materials that may alter the electric properties of paper, the unevenness of image transfer may be induced in the electrophotographic process, depending on the combination and the content thereof.

The recording paper according to the invention preferably has an surface resistivity of at least a face thereof to be printed on in the range of $1.0\times10^{9}$ to $1.0\times10^{11}$ Ω/□ and a volumetric resistivity in the range of $1.0\times10^{10}$ to $1.0\times10^{12}$ Ω·cm. If the surface resistivity and the volumetric resistivity are not in the ranges above, the unevenness of image transfer may be caused in the electrophotographic process.

The surface resistivity is more preferably in the range of $5.0\times10^{9}$ to $7.0\times10^{10}$ Ω/□ and still more preferably in the range of $5.0\times10^{9}$ to $2.0\times10^{10}$ Ω/□. The surface resistivity is a surface resistance as determined after the polyvalent metal salt and/or cationic resin are applied. In addition, the volumetric resistivity is more preferably in the range of $1.3\times10^{10}$ to $1.6\times10^{11}$ Ω·cm and still more preferably in the range of $1.3\times10^{10}$ to $4.3\times10^{10}$ Ω·cm.

The surface resistivity and the volumetric resistivity above are values determined according to the methods specified in JIS-K-6911 by using a recording paper stored and conditioned under a condition of 23° C. and 50% RH for 24 hours.

(Seconds Recording Paper)

Hereinafter, the seconds recording paper according to the invention will be described.

The recording paper according to the invention is characterized in that the recording paper is prepared by applying a surface sizing solution containing at least, a surface sizing agent, a nonionic surfactant having an HLB of 6 to 13 in an amount in the range of 10 to 100% by weight relative to the weight of the surface sizing agent, and a cationic surfactant in an amount in the range of 5 to 150% by weight relative to the weight of the surface sizing agent, onto the surface of a paper (substrate) containing at least a cellulose pulp as the raw material in an amount of 0.1 to 2.0 g/m$^2$ as dry weight on one face.

When images are printed by the ink jet recording process, the recording paper according to the invention (1) enables printing of the images on both faces of papers by suppressing generation of the curl and cockle immediately after printing, and (2) suppresses the curl and cockle generated after the recording paper is left to dry.

In contrast, conventional recording papers used in the ink jet and electrophotographic recording processes, which are not surface-treated with a surfactant or if surface-treated, processed commonly with a surfactant having an HLB of more than 13 in an amount of 0.1 g/m$^2$ or less, have not been able to satisfy the requirements in properties (1) and (2) above of the recording paper according to the invention at a higher level.

In addition, conventional recording papers used in the ink jet recording process are not treated with a sizing solution containing both cationic and nonionic surfactants, and when a nonionic surfactant is applied together with a surface sizing agent, the nonionic surfactant is trapped by the surface sizing agent, lowering the curl-preventing effect and have not been able to satisfy the requirements in properties (1) and (2) above of the recording paper according to the invention at a higher level.

Hereinafter, respective components contained in the surface sizing solution to be applied onto the recording paper according to the invention will be described in detail.

The surface sizing agents according to the invention include, but not particularly limited to, for example, oxidized starches, phosphoesterified starches, homemade modified starches, cationic starches, various modified starches, polyethylene oxide, polyacrylamide, sodium polyacrylate, sodium alginate, hydroxymethylcellulose, carboxymethylcellulose, methylcellulose, polyvinyl alcohol or the derivatives thereof, and the like. Among them, surface sizing agents having anions when dissolved in water, for example, oxidized starches and the like, are preferable for improving the effects of the cationic surfactant.

These surface sizing agents may be used alone or in combination of two or more.

The nonionic surfactant according to the invention preferably has an HLB in the range of 6 to 13, more preferably in the range of 6 to 11, and still more preferably in the range of 7 to 9.

If the HLB is over 13, the nonionic surfactant becomes more hydrophilic, and the effectiveness of the surfactant at coating cellulose in the substrate and reducing dimensional change of the recording paper is lowered, consequently leading to increase in the curl and cockle immediately after printing and after the recording paper is left to dry. If the HLB is less than 6, the surfactant becomes less dispersible, cannot be uniformly present on the paper, and is less effective at reducing dimensional change, thereby increasing the curl and cockle immediately after printing and after the recording paper is left to dry.

Examples of the nonionic surfactants for use in the invention include polyoxyethylene nonylphenylether, polyoxyethylene octylphenylether, polyoxyethylene dodecylphenylether, polyoxyethylene alkylethers, polyoxyethylene fatty acid esters, sorbitan fatty acid esters, acetylene glycol-ethylene oxide adducts, polyoxyethylene sorbitan fatty acid esters, fatty acid alkylol amides, polyethylene glycol-polypropylene glycol block copolymers, polyoxyethylene ethers of glycerin esters, polyoxyethylene ethers of sorbitol esters, and the like.

Among them, acetylene glycol-ethylene oxide adducts are particularly preferable.

The content of the nonionic surfactant in the surface sizing solution according to the invention is in the range of 10 to 100% by weight, preferably in the range of 15 to 50% by weight, and more preferably in the range of 20 to 40% by, relative to the weight of the surface sizing agents.

If the content of the nonionic surfactant is less than 10% by weight, the nonionic surfactant's effect of coating the cellulose in the substrate becomes smaller, and the effect of reducing dimensional change of the recording paper provided by the nonionic surfactant is reduced, thereby increasing the curl and cockle. Alternatively, if the content is more than 100% by weight, the content of the nonionic surfactant is too much, occasionally causing problems such as intercolor bleeding and the like.

Cationic surfactants for use in the invention are, for example, higher alkylmonoamine salts, alkyldiamine salts, and quaternary ammonium salts. Among them, quaternary ammonium salts are preferable.

The content of the cationic surfactant for use in the invention is in the range of 5 to 150% by weight, preferably in the range of 10 to 100% by weight, and more preferably in the range of 20 to 50% by weight relative to the weight of the surface sizing agent.

If the cationic surfactant is present in an amount of less than 5% by weight, the cationic surfactant has a weaker surface sizing capacity, allows a nonionic surfactant to be trapped by a surface sizing agent and reduces the amount of the nonionic surfactant coated on cellulose, consequently reducing the nonionic surfactant's effect of reducing dimensional change and increasing the curl and cockle immediately after printing the curl and cockle after the recording paper is left to dry. If the cationic surfactant is present in an amount of more than 150% by weight, the content of the cationic surfactant becomes too much, occasionally causing problems such as inter-color bleeding and the like.

The recording paper according to the invention is obtained by applying the surface sizing solution containing the respective components above onto the surface of a paper described below in an amount of 0.1 to 2.0 g/m$^2$ as dry weight per one face.

The amount of the surface sizing solution applied is preferably in the range of 1.0 to 2.0 g/m$^2$ as dry weight per one face.

If the application amount is more than 2 g/m$^2$, the absolute amount of the surface sizing agent becomes larger, occasionally preventing the curl-preventing effect by the surfactant and increasing the curl and cockle. Alternatively, if it is less than 0.1 g/m$^2$, the absolute amount of the surface sizing agent becomes smaller, and it may become difficult to fix a pigment, which is applied together with the surface sizing agent, onto the paper surface, generating a greater amount of paper powders and causing mechanical troubles when recording papers are supplied into a copying machine or the like.

These surface sizing solution contains a solvent such as water as the major component, and the concentration of the surface sizing agent, nonionic surfactant and cationic surfactant contained therein is preferably in the range of 1 to 10% by weight and more preferably in the range of 3 to 7% by weight.

Hereinafter, papers whereon the surface sizing solution above is applied will be described in detail.

The paper (substrate) according to the invention contains at least a cellulose pulp as the raw material, and may be a base paper described below or a regular paper prepared by treatment of the surface of the base paper with a pigment, binder, or the like.

The base paper contains a cellulose pulp, and any known cellulose pulp may be used as the cellulose pulp, and examples thereof include chemical pulps such as bleached hardwood Kraft pulp, unbleached hardwood Kraft pulp, bleached softwood Kraft pulp, unbleached softwood Kraft pulp, bleached hardwood sulfite pulp, unbleached hardwood sulfite pulp, bleached softwood sulfite pulp, and unbleached softwood sulfite pulp; pulps prepared by chemical processing of fibrous materials such as wood, cotton, hemp, and soft leather; and the like.

In addition, groundwood pulps mechanically pulped from woods and chips, chemimechanical pulps mechanically pulped from woods and chips previously impregnated with chemicals, thermomechanical pulps pulped in refiner after chips are steamed until they become slightly softer, and the like may also be used. These pulps may be prepared only from a virgin pulp or in combination with a recycled pulp if necessary.

In particular, the virgin pulp is preferably a elementally chlorine free (ECF) pulp bleached not by chlorine gas but by chlorine dioxide, or a total chlorine free (TCF) pulp bleached mainly by ozone/hydrogen peroxide or the like without use of any chlorine compounds.

Raw materials for the recycled pulps include unprinted waste papers of extremely high quality, high quality, medium-grade, low-grade, and other white papers that are cut, damaged, and irregular in size; high quality waste papers such as woodfree and coated woodfree papers that are printed or copied; waste papers printed with inks such as aqueous and oil-based inks or with lead pencils; newspaper waste papers containing advertising leaflets such as printed woodfree paper, woodfree coated paper, wood-containing paper, and wood-containing coated paper; and waste papers of wood-containing papers, coated wood-containing papers, wood papers, and the like, generated in bookmakers, print shops, cutting facilities, and the like.

The recycled pulps used for base papers according to the invention are preferably the pulps of raw waste papers bleached at least either by an ozone or hydrogen peroxide bleaching treatment. For obtaining recording papers higher in whiteness, it is preferable to have a blending ratio of the waste papers obtained by the bleaching treatment above in the range of 50 to 100%. Further from the viewpoint of resource recycling, the blending ratio of the recycled pulps above is preferably in the range of 70 to 100%.

The ozone treatment decomposes fluorescence dyes and the like that are commonly contained in woodfree papers, while the hydrogen peroxide bleaching treatment prevents yellowing caused by the alkalis used in the deinking process. In particular, combined use of these two treatments allows easier deinking of waste papers and at the same time improves the whiteness of the pulps obtained. In addition, the treatment also decomposes and eliminates the chlorine compounds remaining in the pulps and thus is very effective in reducing the content of organic halogen compounds in the waste papers that are bleached with chlorine.

In addition, a filler is preferably added to the base paper for adjustment of the opacity, whiteness, and surface smoothness thereof. It is preferably to use a non-halogen filler particularly if reduction in the halogen content of recording papers is desirable. Examples of the fillers for use include white inorganic pigments such as heavy calcium carbonate, light calcium carbonate, chalk, kaolin, calcined clay, talc, calcium sulfate, barium sulfate, titanium dioxide, zinc oxide, zinc sulfide, zinc arbonate, aluminum silicate, calcium silicate, magnesium silicate, synthetic silica, aluminum hydroxide, alumina, sericite, white carbon, saponite, calcium monmorillonite, sodium monmorillonite, and bentonite; organic pigments such as acrylic plastic pigments, polyethylene, urea resins; and the like. If waste paper is blended, the blending amount of the waste paper is required to be determined by previously estimating the ashes contained in the raw waste-paper.

An internal sizing agent is preferably added to the base paper for use in the invention, and examples of the internal sizing agents include those used in neutral sheeting processes such as neutral rosin-based sizing agents, alkenylsuccinic anhydrides (ASAs), alkylketene dimers (AKDs), and petroleum resin-based sizing agents.

Further, when the surface of recording paper is desirably adjusted to be cationic, the surface can be treated with a cationic substance, for example, a hydrophilic cationic resin or the like, and the paper sizing degree before application of the cationic resin is preferably 10 seconds or more and less than 60 seconds for suppression of penetration of this cationic resin into the paper.

The recording paper according to the invention can be obtained by applying the surface sizing solution above onto the surface of the paper described above. Any one of application means commonly used such as a size press, shim size, gate roll, roll coater, bar coater, air knife coater, rod blade coater, or blade coater may be used as the method of applying the surface sizing solution. The recording paper according to the invention can be obtained after applying a surface sizing solution onto the surface of a paper by one of these application means and then drying the resulting paper.

The basis weight of the recording paper according to the invention is not particularly limited, but is preferably in the range of 60 to 128 g/m$^2$, more preferably in the range of 60 to 100 g/m$^2$, and still more preferably in the range of 60 to 90 g/m$^2$. A higher basis weight is advantageous for preventing the curl and cockle, but if the basis weight becomes larger than 128 g/m$^2$, the paper may become excessively rigid, resulting in decrease in the paper-traveling speed in printer. On the contrary, if it is less than 60 g/m$^2$, it may become more difficult to suppress generation of the curl and cockle and thus such a paper is not favorable from the viewpoint of offset.

The recording paper according to the invention preferably contains a water-soluble metal salt on the surface thereof. When the surface of recording paper contains a water-soluble metal salt and the ink jet ink contains an anionic polymer, cross-linking between these ingredients allows extremely fast coagulation of colorants, provides images excellent in printing quality, and suppresses penetration of the ink solvent into paper, which in turn prevents generation of the curl and cockle immediately after printing and after the recording paper is left to dry.

Examples of the water-soluble metal salts include chloride, sulfate, nitrate, formate, acetate, and other salts of monovalent and polyvalent metals such as potassium, barium, calcium, magnesium, zinc, tin, manganese, and aluminum; and specific examples thereof include barium chloride, calcium chloride, calcium acetate, calcium nitrate, calcium formate, magnesium chloride, manganese sulfate, magnesium nitrate, magnesium acetate, magnesium formate, zinc chloride, zinc sulfate, zinc nitrate, zinc formate, tin chloride, tin nitrate, manganese chloride, manganese sulfate, manganese nitrate, manganese formate, aluminum sulfate, aluminum nitrate, aluminum chloride, aluminum acetate and the like. These salts may be used alone or in combination of two or more. Among the water-soluble metal salts above, metal salts higher in solubility in water and higher in ionic valency are preferable. Further, since use of a strong acid as the counter ion of the polyvalent metal salt often leads to yellowing of paper after application, the metal salt is preferably calcium chloride, calcium formate, magnesium chloride, magnesium formate, or the like.

The water-soluble metal salts listed above can be applied on the surface of recording papers by blending them in a surface sizing solution or by preparing a separate coating solution containing the same. In the latter case, a coating solution obtained by dissolving them in water may be directly applied onto a recording paper (or paper), but is usually blended with a binder before use.

The content of the water-soluble metal salt contained in the recording paper surface is preferably in the range of 0.1 to 2 g/m$^2$ and more preferably in the range of 0.5 to 1 g/m$^2$.

If the content is less than 0.1 g/m$^2$, the reaction with the pigment or the anionic polymer in ink is hindered, consequently leading to deterioration in image quality and increase in the curl and cockle immediately after printing and the curl and cockle after the recording paper is left to dry. Alternatively, if the content is more than 2 g/m$^2$, the ink may become less permeable, causing deterioration in ink drying characteristics during high-speed printing.

<Image Recording Method>

Hereinafter, the image recording method according to the invention will be described.

The image recording method according to the invention is not particularly limited, if the method employs the recording paper according to the invention during printing using an ink jet ink (hereinafter, referred to simply as "ink") or an electronic photographic toner (hereinafter, referred to simply as "toner"). However, the image recording method according to the invention is more preferably an ink jet recording process that employs an ink for obtaining high quality documents.

(Image Recording Method Using the Ink Jet Recording Process)

The image recording method using the ink jet recording process (hereinafter, referred to "ink jet recording process") according to the invention will be described first.

The ink jet recording process according to the invention is an image recording method using the ink jet recording process comprising ejecting an ink droplet onto a recording paper to record an image on a surface thereof, wherein the recording paper used is the recording paper according to the invention.

The ink is not particularly limited if it is an ink known in the art containing at least one colorant, but preferably contains a colorant, an anionic compound, a water-soluble organic solvent, and water as essential components and may contain a pigment dispersant, a surfactant, and various additives, and the like additionally. Hereinafter, respective components will be described.

—Colorant—

Colorants for use in ink include water-soluble dyes, organic pigments, inorganic pigments, and the like.

Colorants for black ink are generally those having a pigment as the main component, and examples of the black pigments include carbon black pigments such as furnace black, lamp black, acetylene black, and channel black, and specific examples thereof include Raven 7000, Raven 5750, Raven 5250, Raven 5000 ULTRA II, Raven 3500, Raven 2000, Raven 1500, Raven 1250, Raven 1200, Raven 1190 ULTRA II, Raven 1170, Raven 1255, Raven 1080, and Raven 1060 (thus far, manufactured by Columbian D. Carbon); Regal 400R, Regal 330R, Regal 660R, Mogul L, Black Pearls L, Monarch 700, Monarch 800, Monarch 880, Monarch 900, Monarch 1000, Monarch 1100, Monarch 1300, and Monarch 1400 (thus far, manufactured by Cabot); Color Black FW1, Color Black FW2, Color Black FW2V, Color Black 18, Color Black FW200, Color Black S150, Color Black S160, Color Black S170, Pritenx 35, Printex U, Printex V, Printex 140U, Printex 140V, Special Black 6, Special Black 5, Special Black 4A, and Special Black 4 (thus far, manufactured by Degussa); No. 25, No. 33, No. 40, No. 47, No. 52, No. 900, No. 2300, MCF-88, MA600, MA7, MA8, and MA100 (thus far, manufactured by Mitsubishi Chemical Co., Ltd.); and the like.

Although it is difficult to specify a favorable structure of carbon blacks, the carbon blacks have an average primary particle diameter in the range of 15 to 30 nm, a BET surface area of 70 to 300 m$^2$/g, a DBP oil absorption of 0.5 to $1.0\times10^{-3}$ L/g, a volatile component content of 0.5 to 10% by weight, an ash content of 0.01 to 1.00% by weight. Use of a carbon black outside the range above may results in increase in the diameter of the particles dispersed in ink.

Any one of dyes, hydrophilic pigments prepared by adding a dispersant containing hydrophilic groups to a hydrophobic pigment, and self-dispersing pigments may be used as colorants for use in cyan, magenta, and yellow inks.

Any one of known or newly prepared dyes may be used as the water-soluble dye. A direct dye or an acid dye, which provide a brilliant color, is preferable among them. Specific examples thereof include C.I. Direct Blue-1, -2, -6, -8, -22, -34, -70, -71, -76, -78, -86, -142, -199, -200, -201, -202, -203, -207, -218, -236 and 287; C.I. Direct Red-1, -2, -4, -8, -9, -11, -13, -20, -28, -31, -33, -37, -39, -51, -59, -62, -63, -73, -75, -80, -81, -83, -87, -90, -94, -95, -99, -101, -110 and -189; C.I. Direct Yellow-1, -2, -4, -8, -11, -12, -26, -27, -28, -33, -34, -41, -44, -48, -86, -87, -88, -135, -142 and -144; C.I. Acid Blue-1, -7, -9, -15, -22, -23, -27, -29, -40, -43, -55, -59, -62, -78, -80, -81, -90, -102, -104, -111, -185 and -254; C.I. Acid Red-1, -4, -8, -13, -14, -15, -18, -21, -26, -35, -37, -249 and -257; C.I. Acid Yellow-1, -3, -4, -7, -11, -12, -13, -14, -19, -23, -25, -34, -38, -41, -42, -44, -53, -55, -61, -71, -76 and -79; and the like. These dyes may be used alone or in combination of two or more.

The cationic dyes include, for example, C.I. Basic Yellow-1, -11, -13, -19, -25, -33, and -36; C.I. Basic Red-1, -2, -9, -12, -13, -38, -39, and -92; C.I. Basic Blue-1, -3, -5, -9, -19, -24, -25, -26, and -28; and the like.

Specific example of cyan pigments include C.I. Pigment Blue-1, C.I. Pigment Blue-2, C.I. Pigment Blue-3, C.I. Pigment Blue-15, C.I, Pigment Blue-15:1, C.I. Pigment Blue-15:3, C.I. Pigment Blue-15:34, C.I. Pigment Blue-16, C.I. Pigment Blue-22, C.I. Pigment Blue-60, and the like.

Specific examples of magenta pigments include C.I. Pigment Red-5, C.I. Pigment Red-7, C.I. Pigment Red-12, C.I. Pigment Red-48, C.I. Pigment Red-48:1, C.I. Pigment Red-57, C.I. Pigment Red-112, C.I. Pigment Red-122, C.I. Pigment Red-123, C.I. Pigment Red-146, C.I. Pigment Red-168, C.I. Pigment Red-184, C.I. Pigment Red-202, and the like.

Specific examples of yellow pigments include C.I. Pigment Yellow-1, C.I. Pigment Yellow-2, C.I. Pigment Yellow-3, C.I. Pigment Yellow-12, C.I. Pigment Yellow-13, C.I. Pigment Yellow-14, C.I. Pigment Yellow-16, C.I. Pigment Yellow-17, C.I. Pigment Yellow-73, C.I. Pigment Yellow-74, C.I. Pigment Yellow-75, C.I. Pigment Yellow-83, C.I. Pigment Yellow-93, C.I. Pigment Yellow-95, C.I. Pigment Yellow-97, C.I. Pigment Yellow-98, C.I. Pigment Yellow-114, C.I. Pigment Yellow-128, C.I. Pigment Yellow-129, C.I. Pigment Yellow-151, C.I. Pigment Yellow-154, and the like.

The pigment for use in the invention may be a pigment self-dispersible in water (self-dispersing pigment). The self-dispersing pigments are those having many water-solubilizing groups on the pigment surface that are dispersible stably in water without presence of a pigment dispersant. Specifically, the self-dispersing pigments can be obtained by subjecting a common so-called pigment to a surface-modification treatment such as an acid/base treatment, coupling-agent treatment, polymer-grafting treatment, plasma treatment, oxidation/reduction treatment, or the like. In addition to the surface-modified pigments above, commercially available self-dispersing pigments such as cab-o-jet-200, cab-o-jet-300, IJX-55, IJX-253, IJX266, and IJX-273 manufactured by Cabot; Nicrojet Black CW-1 manufactured by Orient Chemical Industries, Ltd., and pigments sold from Nippon Shokubai Co., Ltd., and the like may be used as well.

The water-solubilizing group present on the surface of the self-dispersing pigments may be a nonionic, cationic, or anionic group, but is preferably a sulfonic acid, carboxylic acid, hydroxyl, or phosphoric acid group. The sulfonic acid, carboxylic acid, or phosphoric acid group may be used as a free acid, but is preferably in the form of the salt with a basic compound for improvement in water-solubility.

In such a case, the basic compounds that may be used include alkali metals such as sodium, potassium, and lithium, aliphatic amines such as monomethylamine, dimethylamine, and triethylamine; alcohol amines such as monomethanolamine, monoethanolamine, diethanolamine, triethanolamine, and diisopropanolamine; ammonia; and the like. Among them, basic compounds of alkali metals such as sodium, potassium, and lithium are particularly preferably used. It is likely because the basic alkali metal compounds are strong electrolytes and are more effective in accelerating dissociation of acidic groups.

If a pigment is contained in an ink as the colorant, the content of pigment is preferably in the range of 0.5 to 20% by weight and particularly preferably in the range of 2 to 10% by weight. If the content of the pigment is less than 0.5% by weight, the optical density of the resulting printed images may become lower. On the contrary, it is more than 20% by weight, image fixability may deteriorate.

If a dye is contained in an ink as the colorant, the content of the dye is in the range of 0.1 to 10% by weight, preferably in the range of 0.5 to 8% by weight, and more preferably in the range of 0.8 to 6%. A content of more than 10% by weight leads to clogging at print head tips, while a content of less than 0.1% by weight cannot provide sufficiently high image quality.

—Anionic Compound—

The anionic compounds for use in ink include, for example, acids such as carboxylic acids and sulfonic acids and the derivatives thereof, anionic water-soluble polymers, emulsions of anionic polymers, and the like, and anionic pigment dispersants described below may also be used.

Specific examples of the carboxylic acids include carboxylic acids such as formic acid, acetic acid, propionic acid, butyric acid, valeric acid, lactic acid, tartaric acid, benzoic acid, acrylic acid, crotonic acid, butenoic acid, methacrylic acid, tiglic acid, allyl acid, 2-ethyl-2-butenoic acid, oxalic acid, malonic acid, succinic acid, glutaric acid, maleic acid, fumaric acid, methylmaleic acid, and glyceric acid; the polymers and the derivatives thereof; and the like. In addition, the alkali or alkali-earth metal salts, ammonium salts and the like of these compounds may also be used.

Specific examples of the sulfonic acids include sulfonic acids such as benzenesulfonic acid, toluenesulfonic acid, xylenesulfonic acid, benzenedisulfonic acid, benzenetrisulfonic acid, hydroxybenzenesulfonic acid, chlorobenzenesulfonic acid, bromobenzenesulfonic acid, 4-hydroxy-1,3-benzenedisulfonic acid, sodium 4,5-dihydroxybenzene-1,3-disulfonate, and o-aminobenzenesulfonic acid, and the derivatives thereof; and the alkali or alkali-earth metal salts, ammonium salts thereof; and the like.

These compounds are preferably used in the form of a salt with basic compound for improvement in water-solubility. Examples of the compounds that form salts with these compounds include alkali metals such as sodium, potassium, and lithium; aliphatic amines such as monomethylamine, dimethylamine, and triethylamine; alcohol amines such as monomethanol amine, monoethanolamine, diethanolamine, triethanolamine, and diisopropanolamine; ammonia; and the like.

More preferable specific examples of the anionic water-soluble polymers include alkyl acrylate ester-acrylic acid copolymers, styrene-alkyl methacrylate ester-methacrylic acid copolymers, styrene-maleic acid copolymer, styrene-methacrylic acid copolymers, styrene-acrylic acid copolymers, alkyl methacrylate ester-methacrylic acid copolymers, styrene-alkyl acrylate ester-acrylic acid copolymers, styrene-methacrylic acid phenyl ester-methacrylic acid copolymers, styrene-cyclohexyl methacrylate ester-methacrylic acid copolymers, and the like, and the salts and derivatives of these copolymers.

The anionic water-soluble polymer contained in ink preferably has a structure having hydrophilic and hydrophobic portions, and contains a carboxylic acid or a carboxylate salt as the functional group constituting the hydrophilic portion.

Specifically, the anionic water-soluble polymer preferably has one or more functional groups selected form acrylic acid, methacrylic acid and (anhydrous) maleic acid in the monomer constituting the hydrophilic portion.

On the other hand, examples of the monomers constituting the hydrophobic portion for the anionic water-soluble polymers include styrene derivatives such as styrene, α-methylstyrene, and vinyltoluene; vinylcyclohexane, vinylnaphthalene, vinylnaphthalene derivatives, alkyl acrylate esters, alkyl methacrylate esters, methacrylic acid phenylesters, methacrylic acid cycloalkylesters, crotonic acid alkylesters, itaconic acid dialkylesters, maleic acid dialkylesters, and the like. Among them, one or more monomers selected from styrene and alkyl, aryl, and alkylaryl esters of (meth)acrylic acid are preferable.

These anionic water-soluble polymers may be used alone or in combination of two or more. The content of the anionic water-soluble polymer in ink is preferably in the range of 0.1 to 10% by weight and more preferably in the range of 0.3 to 5% by weight. A content of less than 0.1% by weight may lead to deterioration in long-term storage stability or in optical density of printed images, while a content of more than 10% by weight may result in improper ejection of inks or decrease in optical density of printed images.

—Water-soluble Organic Solvent—

Examples of the water-soluble organic solvents for use in inks include polyvalent alcohols such as ethylene glycol, diethylene glycol, propylene glycol, butylene glycol, triethylene glycol, 1,5-pentanediol, 1,2,6-hexanetriol, and glycerin; polyvalent alcohol derivatives such as ethylene glycol monomethylether, ethylene glycol monoethylether, ethylene glycol monobutylether, diethylene glycol monomethylether, diethylene glycol monoethylether, diethylene glycol monobutylether, propylene glycol monobutylether, and dipropylene glycol monobutylether; nitrogen-containing solvents such as pyrrolidone, N-methyl-2-pyrrolidone, cyclohexylpyrrolidone, and triethanolamine; alcohols such as ethanol, isopropyl alcohol, butyl alcohol, and benzyl alcohol; sulfur-containing solvents such as thiodiethanol, thiodiglycerol, sulfolane, and dimethylsulfoxide; propylene and ethylene carbonates; and the like. The water-soluble organic solvents may be used alone or in combination of two or more.

The content of the water-soluble organic solvent in ink is preferably in the range of 1 to 60% by weight and more preferably in the range of 5 to 40% by weight. A content of the water-soluble organic solvent of less than 1% by weight may lead to deterioration in long-term storage stability. Alternatively, a content of more than 60% by weight may lead to deterioration in ejection stability and occasionally to abnormal ejection.

—Water—

Ion-exchange water, distilled water, pure water, ultrapure water, and the like may be used as the water for use in ink.

The content of water in ink is preferably 15 to 98% by weight and particularly preferably in the range of 45 to 90% by weight. A content of less than 15% by weight may lead to deterioration in ejection stability and occasionally to abnormal ejection. Alternatively, a content of more than 98% by weight may lead to deterioration in long-term storage stability.

—Other Components—

A pigment dispersant may be used for dispersion of the pigment contained in ink. Specific examples of the pigment dispersants include polymer dispersants, anionic surfactants, cationic surfactants, amphoteric surfactants, nonionic surfactants, and the like.

Among these pigment dispersants, pigment dispersants forming an organic anion when dissociated in water are called anionic pigment dispersants in the invention. The anionic water-soluble polymer described above may be used as this anionic pigment dispersant.

Any polymer may be used effectively as the polymer dispersant if it has both hydrophilic and hydrophobic structural portions. Examples of the polymers having hydrophilic and hydrophobic structural portions include condensation polymers and addition polymers.

The condensation polymers are, for example, polyester-based dispersants known in the art. The addition polymers are, for example, addition polymers from a monomer having an α, β-ethylenic unsaturated group. It is possible to obtain a desirable polymer dispersant by copolymerizing a monomer having a hydrophilic group and an α,β-ethylenic unsaturated group and a monomer having a hydrophobic group and an α,β-ethylenic unsaturated group in a suitable combination. Alternatively, a homopolymer from a monomer having a hydrophilic group and an α,β-ethylenic unsaturated group may also be used.

Examples of the monomers having a hydrophilic group and an α,β-ethylenic unsaturated group include monomers having a carboxyl, sulfate, hydroxyl, phosphate, or other group, and specific example thereof include acrylic acid, methacrylic acid, crotonic acid, itaconic acid, itaconic acid monoester, maleic acid, maleic acid monoester, fumaric acid, fumaric acid monoester, vinylsulfonic acid, styrenesulfonic acid, sulfonated vinylnaphthalene, vinyl acetate (raw material for polyvinyl alcohol), acrylamide, methacryloxyethyl phosphate, bismethacryloxyethyl phosphate, methacryloxyethyl phenyl acid phosphate, ethylene glycol dimethacrylate, diethylene glycol dimethacrylate, and the like.

On the other hand, examples of the monomers having a hydrophobic group and an α,β-ethylenic unsaturated group include styrene derivative such as styrene, α-methylstyrene, and vinyltoluene; vinylcyclohexane, vinylnaphthalene, vinylnaphthalene derivatives, alkyl acrylate esters, phenyl acrylate esters, alkyl methacrylate esters, methacrylic acid phenylesters, methacrylic acid cycloalkylesters, crotonic acid alkylesters, itaconic acid dialkylesters, maleic acid dialkylesters, and the like.

Examples of the preferable copolymers from these monomers include styrene-styrenesulfonic acid copolymer, styrene-maleic acid copolymer, styrene-methacrylic acid copolymer, styrene-acrylic acid copolymer, vinylnaphthalene-maleic acid copolymer, vinylnaphthalene-methacrylic acid copolymer, vinylnaphthalene-acrylic acid copolymer, alkyl acrylate ester-acrylic acid copolymer, alkyl methacrylate ester-methacrylic acid, styrene-alkyl methacrylate ester-methacrylic acid copolymer, styrene-alkyl acrylate ester-acrylic acid copolymer, styrene-methacrylic acid phenyl ester-methacrylic acid copolymer, styrene-cyclohexyl methacrylate ester-methacrylic acid copolymer, and the like.

In addition, a monomer having a polyoxyethylene or hydroxyl group may be additionally copolymerized into these polymers. For improvement in compatibility with pigments having an acidic functional group on the surface and in dispersion stability, a monomer having a cationic functional group, for example, N-dimethylaminoethyl methacrylate, N,N-dimethylaminoethyl acrylate, N,N-dimethylamino methacrylamide, N,N-dimethylamino acrylamide, N-vinylpyrrole, N-vinylpyridine, N-vinylpyrrolidone, N-vinylimidazole, or the like, may be copolymerized if necessary.

These copolymers may have any structure and thus may be a random, block, graft, or other copolymer. In addition, polystyrenesulfonic acid, polyacrylic acid, polymethallyl acid, polyvinylsulfuric acid, polyalginic acid, polyoxyethylene-polyoxypropylene-polyoxyethylene block copolymers, naphthalenesulfonic acid-formaline condensates, polyvinylpyrrolidone, polyethyleneimine, polyamines, polyamides, polyvinylimidazoline, aminoalkyl acrylate-acrylamide copolymers, chitosan, polyoxyethylene fatty amides, polyvinyl alcohol, polyacrylamide, cellulose derivatives such as carboxymethylcellulose and carboxyethylcellulose, polysaccharides and the derivatives thereof, and the like may also be used.

The hydrophilic group of the pigment dispersant is preferably, but not particularly limited to, a carboxylic acid or a salt of the carboxylic acid.

The degree of neutralization of the pigment dispersant is 50% or more and more preferably 80% or more with respect to the acid value of copolymer. The molecular weight of the pigment dispersant is preferably 2,000 to 15,000 and more preferably 3,500 to 10,000 as weight-average molecular weight (Mw). In addition, the structure and composition of hydrophobic and hydrophilic portions may be decided suitably according to the combination of the pigment and the solvent used.

These pigment dispersants may be used alone or in combination of two or more. The amount of the pigment dispersants added may vary significantly according to the pigment used and is difficult to specify, but is commonly in the range of 0.1 to 100% by weight, preferably in the range of 1 to 70% by weight, and more preferably in the range of 3 to 50% by weight with respect to the pigment.

The ink may also contain a surfactant. The surfactant is added for adjustment of the pigment dispersion in pigment inks and the surface tension and wetness of inks or for solubilization of organic impurities and thus improvement in reliability of the ejection of ink through a nozzle.

Preferable surfactants are nonionic and anionic surfactants that have a smaller influence on the dispersion condition of the water-insoluble colorant or on the solution condition of the water-soluble dye. Examples of the nonionic surfactants include polyoxyethylene nonylphenylether, polyoxyethylene octylphenylether, polyoxyethylene dodecylphenylether, polyoxyethylene alkylethers, polyoxyethylene fatty acid esters, sorbitan fatty acid esters, polyoxyethylene sorbitan fatty acid esters, fatty acid alkylol amides, acetylene alcohol-ethylene oxide adducts, polyethylene glycol-polypropylene glycol block copolymers, polyoxyethylene ethers of glycerin esters, polyoxyethylene ethers of sorbitol ester, and the like.

Examples of the anionic surfactants include alkylbenzenesulfonate salts, alkylphenylsulfonate salts, alkylnaphthalenesulfonate salts, higher fatty acid salts, sulfate ester salts and sulfonate salts of higher fatty esters, higher alkylsulfosuccinate salts, and the like.

In addition, betaines, sulfobetaines, sulfate betaines, imidazoline, and the like may also be used as the amphoteric surfactant. Further, silicone-based surfactants such as polysiloxane-polyoxyethylene adducts, fluorinated surfactants such as oxyethylene perfluoroalkylethers, biosurfactants such as spiculisporic acid, rhamnolipid, and lysolecithin, and the like may also be used. The surfactants may be used alone or in combination of two or more in ink. The addition amount is adjusted suitably according to the desirable properties of the ink such as surface tension and the like.

Further, the ink may also contain if necessary a pH buffering agent, antioxidant, fungicide, viscosity adjuster, conductive agent, ultraviolet absorbent, chelating agent, water-soluble dye, dispersion dye, oil-soluble dye, or the like. The content of these additives in ink is preferably 20% by weight or less.

The inks described above are prepared by adding a particular amount of a colorant into an aqueous solution, stirring sufficiently and dispersing the resulting mixture in a dispersing machine, removing coarse particles by centrifugation or the like, adding a certain solvent, an additive, and the like and mixing the resulting mixture, and then filtering the mixture.

Any one of commercially available dispersing machines may be used. Examples thereof include colloid mill, flow jet mill, Thrasher mill, high-speed disperser, ball mill, attriter, sand mill, sand grinder, ultrafine mill, Eiger motor mill, DYNO-Mill, pearl mill, agitator mill, Covol mill, triple roll, double roll, extruder, kneader, microfluidizer, laboratory homogenizer, ultrasonic homogenizer, and the like, and these dispersing machines may be used alone or in combination of two or more. For prevention of contamination by inorganic impurities, it is preferable to adopt a dispersion method that do not require a dispersion medium, and use of a microfluidizer, an ultrasonic homogenizer, or the like is preferable in such a case.

Inks containing a self-dispersing pigment as the colorant (pigment) may be prepared, for example, by subjecting the pigment to a surface modification treatment; adding the surfaced-treated pigment into water; after mixing the mixture well, dispersing the mixture if necessary in a dispersing machine similar to that described above; removing the coarse particles therein by means of centrifugation or the like; adding a certain solvent, an additive and the like; and subsequently stirring, mixing, and filtering the resulting solution.

The pH of the ink is preferably in the range of 3 to 11 and more preferably in the range of 4.5 to 9.5. For inks containing a pigment having an anionic free group on the surface, the pH of the ink is preferably in the range of 6 to 11, more preferably in the range of 6 to 9.5, and still more preferably in the range of 7.5 to 9.0. On the other hand, for inks containing a pigment having a cationic free group on the surface, the pH of the ink is preferably in the range of 4.5 to 8.0 and more preferably in the range of 4.5 to 7.0.

The viscosity of the ink is preferably in the range of 1.5 to 5.0 mPa·s and more preferably in the range of 1.5 to 4.0 mPa·s. If the viscosity of the ink is higher than 5.0 mPa·s, the ink may become less permeable into recording paper and cause inter-color bleeding. On the other hand, if the viscosity of the ink is lower than 1.5 mPa·s, the ink may become too penetrative, allowing penetration of the ink into the recording paper, only leading to insufficient coagulation of the ink pigment and the anionic compound and occasionally to ink bleeding and deterioration in the density of printed images.

The surface tension of the ink can be adjusted mainly by controlling the amount of the surfactant added, and is preferably adjusted in the range of 25 to 37 mN/m. If the surface tension is less than 25 mN/m, the ink may become too penetrative, allowing penetration of the ink into the recording paper only leading to insufficient coagulation of the ink pigment and the anionic compound and occasionally to ink bleeding and deterioration in the density of printed images. Alternatively, if it is larger than 37 mN/m, the ink becomes less penetrative in the recording paper and may deteriorate the drying characteristics of the ink.

When images are printed with the ink described above onto the recording paper according to the invention in the ink jet process, the volume of the ink drop ejected from a nozzle is preferably in the range of 1 to 20 pl and more preferably in the range of 3 to 18 pl.

When images are formed in the so-called thermal ink jet process, wherein ink droplets are produced by thermal energy and the ink drop volume is in the range of 1 to 20 pl, preferably in the range of 3 to 18 pl, the dispersion particle diameter of the pigment in ink is preferably in the range of 20 to 120 nm as volume average particle diameter, and the number of coarse particles having a diameter of 500 nm or more in 2 μl of ink is preferably $5\times10^5$ or less. A volume average particle diameter of less than 20 nm may lead to insufficient image density. On the contrary, a volume average particle diameter of larger than 120 nm may lead to clogging in print heads, prohibiting reliable ejection of the ink. Further, if the number of coarse particles having a volume average particle diameter of 500 nm or more in 2 μl of ink become larger than $5\times10^5$, the clogging in print heads occurs more frequently, prohibiting reliable ejection of the ink. The number of the coarse particles is more preferably $3\times10^5$ or less and still more preferably $2\times10^5$ or less.

In addition, the elastic modulus of the ink at 24° C. is particularly preferably in the range of $5\times10^{-4}$ to $1\times10^{-2}$ Pa. When the ink has a suitable elasticity in the region, the behavior of the ink on the recording paper surface becomes more favorable. The elastic modulus is a value obtained by measuring in a low-shear rate region, i.e., at an angular rate in the range of 1 to 10 rad/s, and the value can be obtained easily by using an apparatus that allows measurement of viscoelasticity in a low-shear rate region. The measuring devices are, for example, VE-type viscoelasticity analyzer (manufactured by VILASTIC SCIENTIFIC INC.), DCR extremely-low-viscosity viscoelasticity analyzer (manufactured by Paar Physica), and the like.

The ink jet recording process according to the invention provides a favorable printing quality in any ink jet recording processes, if it is a known ink jet device. The ink jet recording process according to the invention may also be applied to a process having a function of heating the recording paper and ink at a temperature of 50° C. to 200° C. and thus accelerating absorption and fixing of the ink by a heating means additionally installed before, during, or after printing.

Hereinafter, an embodiment of the ink jet recording device suitable for the ink jet recording process according to the invention will be described. The device is a so-called multi-path system, wherein images are formed by multiple scans of the recording head over the recording paper surface.

A specific example of the system that ejects ink from nozzles is a so-called thermal ink jet process, wherein the ink in the nozzle is ejected by the pressure caused by foaming of the ink in the nozzle induced by application of electricity to a heater located inside the nozzle. Another example thereof is a system wherein the ink is ejected by the force generated by physical deformation of the nozzles caused by application of electricity to a piezoelectric device. Typically, such a system uses a piezoelectric element for the piezoelectric device. In the ink jet recording device used for the ink jet recording method according to the invention, the method of ejecting ink from nozzles is any one of the above two systems and is not limited to these systems. The same shall apply hereinafter in this respect.

Nozzles are placed in the direction almost orthogonal to the main scanning direction of the head carriage. Specifically, the recording heads are placed in line at a density of 800 pieces per inch. The number and density of the nozzles are arbitrary. In addition, the heads may be placed in a zigzag arrangement, instead of in line.

Ink tanks containing the inks according to the invention respectively in cyan, magenta, yellow and black are connected integrally to the upper portion of the respective recording heads. The inks contained in the ink tanks are supplied to the recording heads corresponding to the respective colors. The ink tanks and the heads may be formed integrally. However, in addition to this system, any other systems, wherein, for example, the ink tanks and the recording heads may be placed separately and the inks may be supplied to the recording heads via ink-supply tubes, may also be used.

Additionally, a signal cable is connected to each of these recording heads. The signal cables transmit the image information processed in a pixel-processing unit concerning respective cyan, magenta, yellow and black colors, to respective recording heads.

The recording heads above are connected to a head carriage. The head carriage is mounted in such a manner that it can slide freely along a guide rod and a carriage guide in the main scanning direction. The head carriage is driven reciprocally via a timing belt along the main scanning direction by activation of a drive motor at certain timing.

A platen is connected to the lower portion of the head carriage, and a recording paper is supplied at certain timing onto the platen by a conveying roller for paper feed. The platen may be, for example, prepared from a plastic molding material or the like.

In this way, the inks described above may be used for printing images on the recording paper according to the invention. A multi-path system equipped with five pieces of heads including the one for a pretreatment solution is described so far above as an example. However, the multi-path systems, to which the ink jet recording method according to the invention is applicable, are not limited to this example. A system equipped with two (black and color) heads, wherein the color head is divided into multiple separate compartments for storing certain different color inks, from which the inks are supplied to multiple nozzles placed along the color head, may also be used.

In a so-called multi-path system wherein a print head travels in the direction orthogonal to the recording-paper feed direction, printing-head scanning speed is a speed of a moving recording head, when the recording head prints an image by scanning multiple times on the surface of recording paper.

For high-speed printing at a printing speed of 10 ppm (10 piece/minute) or more, which is almost equivalent to that of laser printers available in many offices, the printing-head scanning speed should not be less than 25 cm/sec, which leads to a shorter ink-ejection pitch and more frequent inter-color bleeding (ICB). It also demands use of inks lower in surface tension for improving the drying speed of the inks; the use of such inks lower in surface tension, in turn, causes feathering and decrease in image density, and makes the printed characters and images more recognizable from the rear side since the ink is more permeable into paper, making it undesirable to print both faces of the recording paper.

Hereinafter, a second example of the ink jet recording device for carrying out the ink jet recording method according to the invention will be described. The device is called a one-path system, which has a recording head almost identical in width with that of the recording paper. In such a system, printing on a recording paper is completed once the paper travels under the head. The one-path systems provide a greater scanning speed and thus greater productivity than the multi-path systems, and allow higher-speed printing than laser recording systems.

The one-path systems allow high-speed printing easily at a higher recording-paper feed speed (speed of a recording paper passing under the recording head) of 60 mm/sec or more, which is equivalent to 10 ppm or more, as they do not demand scanning of the recording head multiple times as in multi-path systems. However, they also demand ejection of a large amount of ink at the same time, as they cannot print dividedly. Accordingly, conventional ink jet recording processes that do not employ the recording paper according to the invention generated the curl and cockle immediately after printing and the curl and cockle after the recording paper is left to dry.

However, in the ink jet recording process according to the invention, it is possible to suppress generation of the curl and cockle of the recording paper by using the recording paper according to the invention described above, even if images are printed at a high printing-head scanning speed of 250 mm/sec or more in a multi-path system, or at a high-speed printing, i.e., at a recording paper-traveling speed of 60 mm/sec or more while the print heads are fixed in a one-path system.

The scanning speed of the print head is preferably 500 mm/sec or more, and more preferably 1,000 mm/sec or more, from the viewpoint of providing the "productivity equivalent to laser printer". Further, the recording-paper feed speed is preferably 100 mm/sec or more, and more preferably 210 mm/sec or more.

With respect to the ink jet recording method according to the invention, the maximum ink ejection is preferably in the range of 6 to 30 ml/m$^2$.

The maximum ink ejection is an ink quantity ejected in one scan per unit area, when a solid image is formed by using one or more color inks.

In any one of the systems above, the maximum ink ejection should be greater than 6 ml/m$^2$ for ejecting an amount of ink sufficient to form a solid image in fewer scan number. However, even in high-speed printing which demands such a large ink ejection, use of the ink jet recording method according to the invention prevents generation of the curl and cockle of the recording paper after printing.

The maximum ink ejection is preferably in the range of 7 to 20 ml/m$^2$, and more preferably in the range of 7.5 to 10 ml/m$^2$, and still more preferably less than 10 ml/m$^2$.

(Image Recording Method Using the Electrophotographic Process)

The image recording method using the electrophotographic process according to the invention comprises charging an electrostatic latent image holding member surface, exposing the electrostatic latent image holding member surface to light to form an electrostatic latent image thereon, developing the electrostatic latent image formed on the electrostatic latent image holding member surface by using an electrostatic latent image developer to form a toner image, transferring the toner image onto a surface of a rcording paper, and fixing the toner image thereon, wherein the recording paper is the recording paper according to the invention described above.

The image recording method using the electrophotographic process according to the invention provides high quality images like conventional methods and suppresses generation of curl immediately after printing.

The image-forming apparatus according to the invention for use in the image recording method using the electrophotographic process is not particularly restricted, if it utilizes an electrophotographic process having a charging step, exposing step, developing step, transferring step and fixing step. For example, when four color toners in cyan, magenta, yellow, and black are used, a color image-forming apparatus by 4-cycle developing process wherein toner images are formed by applying developer containing the toners in respective colors sequentially onto a photosensitive body or a color image-forming apparatuses (so-called tandem systems) having four developing units corresponding to respective colors, and the like may be used.

The toners for use in image formation are also not particularly limited and may be any of the toners known in the art, and, for example, spherical toners smaller in particle diameter and in particle size distribution may be used for obtaining high-accuracy images, and low-temperature fixable toners containing a binder resin having a lower melting point may be used for energy conservation.

EXAMPLES

Hereinafter, the present invention will be described in detail with reference to examples separately with respect to the first and seconds recording papers, but it should be understood that the invention is not restricted to these examples. Inks and recording papers used in examples and comparative examples are first described, before the various evaluation results when images are printed in combination of these inks and recording papers.

1. Examples Using First Recording Paper (1) Preparation of Inks

Two kinds of inks, dye-based ink set 1 and pigment-based ink set 2, are prepared. Physical properties of the inks below are determined under the following conditions: Surface tension is determined by using a Wilhelmy surface tension balance in an environment of 23° C. and 55% RH. Viscosity is determined by placing a test ink in a measuring container, placing the container in Neomat 115 (manufactured by Contraves) and measuring at a temperature of 23° C. and a shear rate of 1400 s$^{-1}$.

<Ink Set 1 (Color Dye Ink)>

—Magenta Ink—

Direct Red 227 (10% by weight aqueous solution): 20 parts by weight

Ethylene glycol: 25 parts by weight

Urea: 5 parts by weight

Surfactant (Surfynol 465, manufactured by Nisshin Chemical Industry Co., Ltd.): 2 parts by weight Deionized water is added to the composition above, and the mixture (100 parts by weight) is stirred for 30 minutes. Then, the mixture is filtered through a membrane filter having an opening of 1 μm. The surface tension of the ink is 31 mN/m, and the viscosity 2.0 mPa·s.

—Cyan Ink—

Direct Blue-142 (10% by weight aqueous solution): 20 parts by weight

Ethylene glycol: 25 parts by weight

Urea: 5 parts by weight

Surfactant (Surfynol 465, manufactured by Nisshin Chemical Industry Co., Ltd.): 2 parts by weight Deionized water is added to the composition above, and the mixture (100 parts by weight) is stirred for 30 minutes. Then, the mixture is filtered through a membrane filter having an opening of 1 μm. The surface tension of the ink is 31 mN/m, and the viscosity 2.0 mPa·s.

—Yellow Ink—

Direct Yellow 144 (10% by weight aqueous solution): 20 parts by weight

Ethylene glycol: 25 parts by weight

Urea: 5 parts by weight

Surfactant (Surfynol 465, manufactured by Nisshin Chemical Industry Co., Ltd.): 2 parts by weight Deionized water is added to the composition above, and the mixture (100 parts by weight) is stirred for 30 minutes. Then, the mixture is filtered through a membrane filter having an opening of 1 μm. The surface tension of the ink is 31 mN/m, and the viscosity 2.0 mPa·s.

<Ink Set 2 (Pigment Ink)>

—Black Ink—

A surface-treated pigment (Cab-o-jet-300, manufactured by Cabot): 4 parts by weight Styrene-maleic acid-sodium maleate copolymer: 0.5 part by weight Diethylene glycol: 20 parts by weight Surfactant (Surfynol 465, manufactured by Nisshin Chemical Industry Co., Ltd.): 0.5 part by weight Urea: 5 parts by weight Ion-exchange water: 70 parts by weight The composition is stirred for 30 minutes. Then, the composition is filtered through a membrane filter having an opening of 1 μm. The surface tension of the ink is 32 mN/m, and the viscosity 2.8 mPa·s.

—Cyan Ink—

A surface-treated pigment (IJX-253, manufactured by Cabot): 4 parts by weight

Styrene-maleic acid-sodium maleate copolymer: 0.5 part by weight

Diethylene glycol: 20 parts by weight

Surfactant (Surfynol 465, manufactured by Nisshin Chemical Industry Co., Ltd.): 0.5 part by weight Urea: 5 parts by weight Ion-exchange water: 70 parts by weight The composition is stirred for 30 minutes. Then, the composition is filtered through a membrane filter having an opening of 1 μm. The surface tension of the ink is 32 mN/m, and the viscosity 2.5 mPa·s.

—Magenta Ink—

A surface-treated pigment (IJX-266, manufactured by Cabot); 4 parts by weight

Styrene-maleic acid-sodium maleate copolymer: 0.5 part by weight

Diethylene glycol: 20 parts by weight

Surfactant (Surfynol 465, manufactured by Nisshin Chemical Industry Co., Ltd.): 0.5 part by weight Urea: 5 parts by weight Ion-exchange water: 70 parts by weight The composition is stirred for 30 minutes. Then, the composition is filtered through a membrane filter having an opening of 1 μm. The surface tension of the ink is 33 mN/m, and the viscosity 2.7 mPa·s.

—Yellow Ink—

A surface-treated pigment (IJX-2.73, manufactured by Cabot): 4 parts by weight

Styrene-maleic acid-sodium maleate copolymer: 0.5 part by weight

Diethylene glycol: 20 parts by weight

Surfactant (Surfynol 465, manufactured by Nisshin Chemical Industry Co., Ltd.): 0.5 part by weight Urea: 5 parts by weight Ion-exchange water: 70 parts by weight The composition is stirred for 30 minutes. Then, the composition is filtered through a membrane filter having an opening of 1 μm. The surface tension of the ink is 33 mN/m, and the viscosity 2.7 mPa·s.

(2) Preparation of Recording Papers

The following recording papers (1) to (28) are prepared.

<Recording Paper (1)>

Green 100 Papers manufactured by Fuji Xerox Office Supply Co., Ltd. (recycled wood-containing paper) are size-pressed with a 5% by weight aqueous solution (surface sizing solution) containing 100 parts by weight of a surface sizing agent having a contact angle with water of 49° (a phosphoesterified starch, Nisshoku MS#4600, manufactured by Nihon Shokuhinkako Co., Ltd.) and 16.6 parts by weight of an ether-based nonionic surfactant (Surfynol 440, manufactured by Nisshin Chemical Industry Co., Ltd., HLB: 8) at a processing amount on paper of 1 $g/m^2$ as dry weight (provided amount of surfactant: 0.14 $g/m^2$), by using a laboratory size press manufactured by Kumagai Riki Kogyo Co., Ltd., and dried in KRK rotary dryer manufactured by Kumagai Riki Kogyo Co., Ltd. under the condition of 110° C. and 0.5 m/min, to give a recording paper (1) having a basis weight of 69 $g/m^2$.

<Recording Paper (2)>

Green 100 Papers manufactured by Fuji Xerox Office Supply Co., Ltd. (recycled wood-containing paper) are size-pressed with a 5% by weight aqueous solution (surface sizing solution) containing 100 parts by weight of a surface sizing agent having a contact angle with water of 49° (dialdehyde starch, a gas-phase-oxidized starch, manufactured by Oji Cornstarch Co., Ltd.) and 16.6 parts by weight of an ether-based nonionic surfactant (manufactured by Nisshin Chemical Industry Co., Ltd., Surfynol 465, HLB: 13) at a processing amount on paper of 1 $g/m^2$ as dry weight (provided amount of surfactant: 0.14 $g/m^2$), by using a laboratory size press manufactured by Kumagai Riki Kogyo Co., Ltd., and dried in KRK rotary dryer manufactured by Kumagai Riki Kogyo Co., Ltd. under the condition of 110° C. and 0.5 m/min, to give a recording paper (2) having a basis weight of 69 $g/m^2$.

<Recording Paper (3)>

Green 100 Papers manufactured by Fuji Xerox Office Supply Co., Ltd. (recycled wood-containing paper) are size-pressed with a 5% by weight aqueous solution (surface sizing solution) containing 100 parts by weight of a surface sizing agent having a contact angle with water of 49° (a phosphoesterified starch, Nisshoku MS#4600, manufactured by Nihon Shokuhinkako Co., Ltd.) and 5.0 parts by weight of an ether-based nonionic surfactant (Surfynol 440, manufactured by Nisshin Chemical Industry Co., Ltd., HLB: 8) at a processing amount on paper of 2 g/m$^2$ as dry weight (provided amount of surfactant: 0.10 g/m$^2$), by using a laboratory size press manufactured by Kumagai Riki Kogyo Co., Ltd., and dried in KRK rotary dryer manufactured by Kumagai Riki Kogyo Co., Ltd. under the condition of 110° C. and 0.5 m/min, to give a recording paper (2) having a basis weight of 70 g/m$^2$.

<Recording Paper (4)>

Green 100 Papers manufactured by Fuji Xerox Office Supply Co., Ltd. (recycled wood-containing paper) are size-pressed with a 5% by weight aqueous solution (surface sizing solution) containing 100 parts by weight of a surface sizing agent having a contact angle with water of 49° (a phosphoesterified starch, Nisshoku MS#4600, manufactured by Nihon Shokuhinkako Co., Ltd.) and 1.0 part by weight of an ether-based nonionic surfactant (Surfynol 440, manufactured by Nisshin Chemical Industry Co., Ltd., HLB: 8) at a processing amount on paper of 1 g/m$^2$ as dry weight (provided amount of surfactant: 0.02 g/m$^2$), by using a laboratory size press manufactured by Kumagai Riki Kogyo Co., Ltd., and dried in KRK rotary dryer manufactured by Kumagai Riki Kogyo Co., Ltd. under the condition of 110° C. and 0.5 m/min, to give a recording paper (4) having a basis weight of 69 g/m$^2$.

<Recording Paper (5)>

Green 100 Papers manufactured by Fuji Xerox Office Supply Co., Ltd. (recycled wood-containing paper) are size-pressed with a 5% by weight aqueous solution (surface sizing solution) containing 100 parts by weight of a surface sizing agent having a contact angle with water of 47° (a high-saponification polyvinyl alcohol, PVA124, manufactured by Kuraray) and 16.6 parts by weight of an ether-based nonionic surfactant (Surfynol 440, manufactured by Nisshin Chemical Industry Co., Ltd., HLB: 8) at a processing amount on paper of 0.5 g/m$^2$ as dry weight (provided amount of surfactant: 0.11 g/m$^2$), by using a laboratory size press manufactured by Kumagai Riki Kogyo Co., Ltd., and dried in KRK rotary dryer manufactured by Kumagai Riki Kogyo Co., Ltd. under the condition of 110° C. and 0.5 m/min, to give a recording paper (5) having a basis weight of 69 g/m$^2$.

<Recording Paper (6)>

Green 100 Papers manufactured by Fuji Xerox Office Supply Co., Ltd. (recycled wood-containing paper) are size-pressed with a 5% by weight aqueous solution (surface sizing solution) containing 100 parts by weight of a surface sizing agent having a contact angle with water of 29° (an oxidized starch, Ace A, manufactured by Oji Cornstarch Co., Ltd.) and 16.6 parts by weight of an ether-based nonionic surfactant (Surfynol 440, manufactured by Nisshin Chemical Industry Co., Ltd., HLB: 8) at a processing amount on paper of 1 g/m$^2$ as dry weight (provided amount of surfactant: 0.14 g/m$^2$), by using a laboratory size press manufactured by Kumagai Riki Kogyo Co., Ltd., and dried in KRK rotary dryer manufactured by Kumagai Riki Kogyo Co., Ltd. under the condition of 110° C. and 0.5 m/min, to give a recording paper (6) having a basis weight of 69 g/m$^2$.

<Recording Paper (7)>

Green 100 Papers manufactured by Fuji Xerox Office Supply Co., Ltd. (recycled wood-containing paper) are size-pressed with a 5% by weight aqueous solution (surface sizing solution) containing 100 parts by weight of a surface sizing agent having a contact angle with water of 49° (a phosphoesterified starch, Nisshoku MS#4600, manufactured by Nihon Shokuhinkako Co., Ltd.) and 16.6 parts by weight of an ether-based nonionic surfactant (Surfynol 485, manufactured by Nisshin Chemical Industry Co., Ltd., HLB: 17) at a processing amount on paper of 1 g/m$^2$ as dry weight (provided amount of surfactant: 0.14 g/m$^2$), by using a laboratory size press manufactured by Kumagai Riki Kogyo Co., Ltd., and dried in KRK rotary dryer manufactured by Kumagai Riki Kogyo Co., Ltd. under the condition of 110° C. and 0.5 m/min, to give a recording paper (7) having a basis weight of 69 g/m$^2$.

<Recording Paper (8)>

Green 100 Papers manufactured by Fuji Xerox Office Supply Co., Ltd. (recycled wood-containing paper) are size-pressed with a 5% by weight aqueous solution (surface sizing solution) containing 100 parts by weight of a surface sizing agent having a contact angle with water of 49° (a phosphoesterified starch, Nisshoku MS#4600, manufactured by Nihon Shokuhinkako Co., Ltd.) and 16.6 parts by weight of an ether-based nonionic surfactant (Surfynol 420, manufactured by Nisshin Chemical Industry Co., Ltd., HLB: 4) at a processing amount on paper of 1 g/m$^2$ as dry weight (provided amount of surfactant: 0.14 g/m$^2$), by using a laboratory size press manufactured by Kumagai Riki Kogyo Co., Ltd., and dried in KRK rotary dryer manufactured by Kumagai Riki Kogyo Co., Ltd. under the condition of 110° C. and 0.5 m/min, to give a recording paper (8) having a basis weight of 69 g/m$^2$.

<Recording Paper (9)>

Green 100 Papers manufactured by Fuji Xerox Office Supply Co., Ltd. (recycled wood-containing paper) are size-pressed with a 5% by weight aqueous solution (surface sizing solution) containing 100 parts by weight of a surface sizing agent having a contact angle with water of 49° (a phosphoesterified starch, Nisshoku MS#4600, manufactured by Nihon Shokuhinkako Co., Ltd.) and 0.05 parts by weight of an ether-based nonionic surfactant (Surfynol 440, manufactured by Nisshin Chemical Industry Co., Ltd., HLB: 8) at a processing amount on paper of 1 g/m$^2$ as dry weight (provided amount of surfactant: 0.005 g/m$^2$), by using a laboratory size press manufactured by Kumagai Riki Kogyo Co., Ltd., and dried in KRK rotary dryer manufactured by Kumagai Riki Kogyo Co., Ltd. under the condition of 110° C. and 0.5 m/min, to give a recording paper (9) having a basis weight of 69 g/m$^2$.

<Recording Paper (10)>

Green 100 Papers manufactured by Fuji Xerox Office Supply Co., Ltd. (recycled wood-containing paper) are size-pressed with a 5% by weight aqueous solution (surface sizing solution) containing 100 parts by weight of a surface sizing agent having a contact angle with water of 39° (an oxidized starch, Ace B, manufactured by Oji Cornstarch Co., Ltd.) and 16.6 parts by weight of an ether-based nonionic surfactant (Surfynol 440, manufactured by Nisshin Chemical Industry Co., Ltd., HLB: 8) at a processing amount on paper of 1 g/m$^2$ as dry weight (provided amount of surfactant: 0.14 g/m$^2$), by using a laboratory size press manufactured by Kumagai Riki Kogyo Co., Ltd., and dried in KRK rotary dryer manufactured by Kumagai Riki Kogyo Co., Ltd. under the condition of 110° C. and 0.5 m/min, to give a recording paper (10) having a basis weight of 69 g/m$^2$.

<Recording Paper (11)>

Dry pulp, a beaten hardwood Kraft pulp adjusted to a freeness of 420 ml, is dispersed at a pulp solid content of 0.3% by weight, to give a pulp dispersion.

To the pulp dispersion, 0.3 part by weight of succinic anhydride (ASA) internal sizing agent (Fibran-81, manufactured by National Starch and Chemical Company) and 0.5 part by weight of a cationic starch (Cato-304, National Starch and Chemical Company) are added with respect to 100 parts by weight of pulp solid content in the pulp dispersion, and papers are sheeted in a laboratory orientation paper machine manufactured by Kumagai Riki Kogyo Co., Ltd. by using a 80-mesh wire screen at a sheeting speed of 1,000 m/min and a paper-ejection pressure of 1.5 kg/cm$^2$. Then, the papers are compressed under 10 kg/cm$^2$ for 3 minutes by a rectangular sheet press machine manufactured by Kumagai Riki Kogyo Co., Ltd., and dried in KRK rotary dryer manufactured by Kumagai Riki Kogyo Co., Ltd. under the condition of 110° C. and 0.5 m/min, to give base papers having a basis weight of 69 μm$^2$.

The base papers are size pressed with a 5% by weight aqueous solution (surface sizing solution) containing 50 parts by weight of a surface sizing agent, i.e., an oxidized starch (Ace A, manufactured by Oji Cornstarch Co., contact angle with water: 39°) and 50 parts by weight polyvinyl alcohol (PVA102, manufactured by Kuraray Co., Ltd., saponification value: 99, polymerization degree: 200, contact angle with water: 64°), 10 parts by weight of mirabilite, 50 parts by weight of am ester-based nonionic surfactant (EMALEX TSG-10, manufactured by Nihon-Emulsion Co., Ltd., HLB: 8) at a processing amount on the base paper of 1 g/m$^2$ (provided amount of surfactant: 0.3 g/m$^2$), by using a laboratory size press manufactured by Kumagai Riki Kogyo Co., Ltd., and dried in KRK rotary dryer manufactured by Kumagai Riki Kogyo Co., Ltd. under the condition of 110° C. and 0.5 m/min, to give a recording paper (11) having a basis weight of 70 g/m$^2$'.

<Recording Paper (12)>

Base papers having a basis weight of 69 g/m$^2$ prepared in a similar manner to recording paper (11) are size-pressed with a 5% by weight aqueous solution (surface sizing solution) containing surface sizing agents (50 parts by weight of an oxidized starch (Ace A, manufactured by Oji Cornstarch Co., contact angle with water: 39°) and 50 parts by weight of polyvinyl alcohol (PVA102, manufactured by Kuraray Co., Ltd., saponification value: 99, polymerization degree: 200, contact angle with water: 64°)), 10 parts by weight of mirabilite, and 50 parts by weight of an ester-based nonionic surfactant (EMALEX SPIS-100, manufactured by Nihon-Emulsion Co., Ltd., HLB: 10) at a processing amount on the base paper of 1 g/m$^2$ (provided amount of surfactant: 0.3 g/m$^2$), by using a laboratory size press manufactured by Kumagai Riki Kogyo Co., Ltd., and dried in KRK rotary dryer manufactured by Kumagai Riki Kogyo Co., Ltd. under the condition of 110° C. and 0.5 m/min, to give a recording paper (12) having a basis weight of 70 g/m$^2$.

<Recording Paper (13)>

Base papers having a basis weight of 69 g/m$^2$ prepared in a similar manner to recording paper (11) are size-pressed with a 5% by weight aqueous solution (surface sizing solution) containing surface sizing agents (50 parts by weight of an oxidized starch (Ace A, manufactured by Oji Cornstarch Co., contact angle with water: 39°) and 50 parts by weight of polyvinyl alcohol (PVA102, manufactured by Kuraray Co., Ltd., saponification value: 99, polymerization degree: 200, contact angle with water: 64°)), 10 parts by weight of mirabilite, and 50 parts by weight of an ester-based nonionic surfactant (EMALEX GMS-B, manufactured by Nihon-Emulsion Co., Ltd., HLB: 6) at a processing amount on the base paper of 1 g/m$^2$ (provided amount of surfactant: 0.3 g/m$^2$), by using a laboratory size press manufactured by Kumagai Riki Kogyo Co., Ltd., and dried in KRK rotary dryer manufactured by Kumagai Riki Kogyo Co., Ltd. under the condition of 110° C. and 0.5 m/min, to give a recording paper (13) having a basis weight of 70 g/m$^2$.

<Recording Paper (14)>

Base papers having a basis weight of 69 g/m$^2$ prepared in a similar manner to recording paper (11) are size-pressed with a 5% by weight aqueous solution (surface sizing solution) containing surface sizing agents (50 parts by weight of an oxidized starch (Ace A, manufactured by Oji Cornstarch Co., contact angle with water: 39°) and 11 parts by weight of polyvinyl alcohol (PVA102, manufactured by Kuraray Co., Ltd., saponification value: 99, polymerization degree: 200, contact angle with water: 64°)), 10 parts by weight of mirabilite, and 50 parts by weight of an ester-based nonionic surfactant (EMALEX TSG-10, manufactured by Nihon-Emulsion Co., Ltd., HLB: 8) at a processing amount on the base paper of 1 g/m$^2$ (provided amount of surfactant: 0.1 g/m$^2$), by using a laboratory size press manufactured by Kumagai Riki Kogyo Co., Ltd., and dried in KRK rotary dryer manufactured by Kumagai Riki Kogyo Co., Ltd. under the condition of 110° C. and 0.5 m/min, to give a recording paper (14) having a basis weight of 70 g/m$^2$.

<Recording Paper (15)>

Base papers having a basis weight of 69 g/m$^2$ prepared in a similar manner to recording paper (11) are size-pressed with a 5% by weight aqueous solution (surface sizing solution) containing surface sizing agents (50 parts by weight of an oxidized starch (Ace A, manufactured by Oji Cornstarch Co., contact angle with water: 39°) and 50 parts by weight of polyvinyl alcohol (PVA102, manufactured by Kuraray Co., Ltd., saponification value: 99, polymerization degree: 200, contact angle with water: 64°)), 10 parts by weight of mirabilite, and 100 parts by weight of an ester-based nonionic surfactant (EMALEX TSG-10, manufactured by Nihon-Emulsion Co., Ltd., HLB: 8) at a processing amount on the base paper of 2 g/m$^2$ (provided amount of surfactant: 1.0 g/m$^2$), by using a laboratory size press manufactured by Kumagai Riki Kogyo Co., Ltd., and dried in KRK rotary dryer manufactured by Kumagai Riki Kogyo Co., Ltd. under the condition of 110° C. and 0.5 m/min, to give a recording paper (15) having a basis weight of 71 g/m$^2$.

<Recording Paper (16)>

Base papers having a basis weight of 69 g/m$^2$ prepared in a similar manner to recording paper (11) except that the amount of the internal sizing agent used is changed to 0.4 part by weight are size-pressed with a 5% by weight aqueous solution (surface sizing solution) containing surface sizing agents (50 parts by weight of an oxidized starch (Ace A, manufactured by Oji Cornstarch Co., contact angle with water: 39°) and 11 parts by weight of polyvinyl alcohol (PVA102, manufactured by Kuraray Co., Ltd., saponification value: 99, polymerization degree: 200, contact angle with water: 64°)), 10 parts by weight of mirabilite, and 50 parts by weight of an ester-based nonionic surfactant (EMALEX TSG-10, manufactured by Nihon-Emulsion Co., Ltd., HLB:8) at a processing amount on the base paper of 1 g/m$^2$ (provided amount of surfactant: 0.1 g/m$^2$), by using a laboratory size press manufactured by Kumagai Riki Kogyo Co., Ltd., and dried in KRK rotary dryer manufactured by Kumagai Riki Kogyo Co., Ltd. under the condition of 110° C. and 0.5 m/min, to give a recording paper (16) having a basis weight of 70 g/m$^2$.

<Recording Paper (17)>

Base papers having a basis weight of 69 g/m$^2$ prepared in a similar manner to recording paper (11) except that the amount of the internal sizing agent used is changed to 0.1 part by weight are size-pressed with a 5% by weight aqueous solution (surface sizing solution) containing surface sizing agents (50 parts by weight of an oxidized starch (Ace A, manufactured by Oji Cornstarch Co., contact angle with water: 39°) and 50 parts by weight of polyvinyl alcohol (PVA102, manufactured by Kuraray Co., Ltd., saponification value: 99, polymerization degree: 200, contact angle with water: 64°)), 10 parts by weight of mirabilite, and 50 parts by weight of an ester-based nonionic surfactant (EMALEX TSG-10, manufactured by Nihon-Emulsion Co., Ltd., HLB:8) at a processing amount on the base paper of 1 g/m$^2$ (provided amount of surfactant: 0.3 g/m$^2$), by using a laboratory size press manufactured by Kumagai Riki Kogyo Co., Ltd., and dried in KRK rotary dryer manufactured by Kumagai Riki Kogyo Co., Ltd. under the condition of 110° C. and 0.5 m/min, to give a recording paper (17) having a basis weight of 70 g/m$^2$.

<Recording Paper (18)>

Base papers having a basis weight of 69 g/m$^2$ prepared in a similar manner to recording paper (11) are size-pressed with a 5% by weight aqueous solution (surface sizing solution) containing surface sizing agents (10 parts by weight of an oxidized starch (Ace A, manufactured by Oji Cornstarch Co., contact angle with water: 39°) and 90 parts by weight of polyvinyl alcohol (PVA102, manufactured by Kuraray Co., Ltd., saponification value: 99, polymerization degree: 200, contact angle with water: 64°)), 10 parts by weight of mirabilite, and 50 parts by weight of an ester-based nonionic surfactant (EMALEX TSG-10, manufactured by Nihon-Emulsion Co., Ltd., HLB:8) at a processing amount on the base paper of 1 g/m$^2$ (provided amount of surfactant: 0.3 g/m$^2$), by using a laboratory size press manufactured by Kumagai Riki Kogyo Co., Ltd., and dried in KRK rotary dryer manufactured by Kumagai Riki Kogyo Co., Ltd. under the condition of 110° C. and 0.5 m/min, to give a recording paper (18) having a basis weight of 70 g/m$^2$.

<Recording Paper (19)>

Base papers having a basis weight of 69 g/m$^2$ prepared in a similar manner to recording paper (11) are size-pressed with a 5% by weight aqueous solution (surface sizing solution) containing surface sizing agents (50 parts by weight of an oxidized starch (Ace A, manufactured by Oji Cornstarch Co., contact angle with water: 39°) and 50 parts by weight of polyvinyl alcohol (phosphoesterified starch #4600, manufactured by Nihon Shokuhin Kako Co., Ltd., contact angle with water: 56°)), 10 parts by weight of mirabilite, and 50 parts by weight of an ester-based nonionic surfactant (EMALEX TSG-10, manufactured by Nihon-Emulsion Co., Ltd., HLB:8) at a processing amount on the base paper of 1 g/m$^2$ (provided amount of surfactant: 0.3 g/m$^2$), by using a laboratory size press manufactured by Kumagai Riki Kogyo Co., Ltd., and dried in KRK rotary dryer manufactured by Kumagai Riki Kogyo Co., Ltd. under the condition of 110° C. and 0.5 m/min, to give a recording paper (19) having a basis weight of 70 g/m$^2$.

<Recording Paper (20)>

Base papers having a basis weight of 69 g/m$^2$ prepared in a similar manner to recording paper (11) are size-pressed with a 5% by weight aqueous solution (surface sizing solution) containing surface sizing agents (50 parts by weight of an oxidized starch (Ace A, manufactured by Oji Cornstarch Co., contact angle with water: 39°) and 50 parts by weight of polyvinyl alcohol (PVA110, manufactured by Kuraray Co., Ltd., saponification value: 99, polymerization degree: 1000, contact angle with water: 68°)), 10 parts by weight of mirabilite, and 50 parts by weight of an ester-based nonionic surfactant (EMALEX TSG-10, manufactured by Nihon-Emulsion Co., Ltd., HLB:8) at a processing amount on the base paper of 1 g/m$^2$ (provided amount of surfactant: 0.3 g/m$^2$), by using a laboratory size press manufactured by Kumagai Riki Kogyo Co., Ltd., and dried in KRK rotary dryer manufactured by Kumagai Riki Kogyo Co., Ltd. under the condition of 110° C. and 0.5 m/min, to give a recording paper (20) having a basis weight of 70 g/m$^2$.

<Recording Paper (21)>

Base papers having a basis weight of 69 g/m$^2$ prepared in a similar manner to recording paper (11) are size-pressed with a 5% by weight aqueous solution (surface sizing solution) containing surface sizing agents (50 parts by weight of an oxidized starch (Ace A, manufactured by Oji Cornstarch Co., contact angle with water: 39°) and 50 parts by weight of polyvinyl alcohol (PVA505, manufactured by Kuraray Co., Ltd., saponification value: 73, polymerization degree: 500, contact angle with water: 55°)), 10 parts by weight of mirabilite, and 50 parts by weight of an ester-based nonionic surfactant (EMALEX TSG-10, manufactured by Nihon-Emulsion Co., Ltd., HLB:8) at a processing amount on the base paper of 1 g/m$^2$ (provided amount of surfactant: 0.3 g/m$^2$), by using a laboratory size press manufactured by Kumagai Riki Kogyo Co., Ltd., and dried in KRK rotary dryer manufactured by Kumagai Riki Kogyo Co., Ltd. under the condition of 110° C. and 0.5 m/min, to give a recording paper (21) having a basis weight of 70 g/m$^2$.

<Recording Paper (22)>

Base papers having a basis weight of 69 g/m$^2$ prepared in a similar manner to recording paper (11) are size-pressed with a 5% by weight aqueous solution (surface sizing solution) containing surface sizing agents (50 parts by weight of an oxidized starch (Ace A, manufactured by Oji Cornstarch Co., contact angle with water: 39°) and 50 parts by weight of polyvinyl alcohol (PVA102, manufactured by Kuraray Co., Ltd., saponification value: 99, polymerization degree: 200, contact angle with water: 64°)), 10 parts by weight of mirabilite, 50 parts by weight of an ester-based nonionic surfactant (EMALEX TSG-10, manufactured by Nihon-Emulsion Co., Ltd., HLB:8), and 75 parts by weight of calcium chloride as a polyvalent metal salt at a processing amount on the base paper of 1.5 g/m$^2$ (provided amount of surfactant: 0.4 g/m$^2$), by using a laboratory size press manufactured by Kumagai Riki Kogyo Co., Ltd., and dried in KRK rotary dryer manufactured by Kumagai Riki Kogyo Co., Ltd. under the condition of 110° C. and 0.5 m/min, to give a recording paper (22) having a basis weight of 71 g/m$^2$.

<Recording Paper (23)>

Recording papers (23) having a basis weight of 70 g/m$^2$ and a formation index of 15 are obtained in a similar manner to the preparation of recording paper (21), except that the freeness of the base papers used in preparation of recording paper (11) is changed to 500 ml.

<Recording Paper (24)>

Base papers having a basis weight of 69 g/m$^2$ prepared in a similar manner to recording paper (11) are size-pressed with a 5% by weight aqueous solution (surface sizing solution) containing surface sizing agents (25 parts by weight of an oxidized starch (Ace A, manufactured by Oji Cornstarch Co., contact angle with water: 39°) and 25 parts by weight of polyvinyl alcohol (PVA102, manufactured by Kuraray Co., Ltd., saponification value: 99, polymerization degree: 200, contact angle with water: 64°)), and 100 parts by weight of an ester-based nonionic surfactant (EMALEX TSG-10, manufactured by Nihon-Emulsion Co., Ltd., HLB: 8), at a processing amount on the base paper of 3 g/m$^2$ (provided amount of surfactant: 2.0 g/m$^2$), by using a laboratory size press manufactured by Kumagai Riki Kogyo Co., Ltd., and dried in KRK rotary dryer manufactured by Kumagai Riki Kogyo Co., Ltd. under the condition of 110° C. and 0.5 m/min, to give a recording paper (24) having a basis weight of 72 g/m$^2$.

<Recording Paper (25)>

Base papers having a basis weight of 69 g/m$^2$ prepared in a similar manner to recording paper (11) are size-pressed with a 5% by weight aqueous solution (surface sizing solution) containing surface sizing agents (50 parts by weight of an oxidized starch (Ace A, manufactured by Oji Cornstarch Co., contact angle with water: 39°) and 50 parts by weight of polyvinyl alcohol (PVA102, manufactured by Kuraray Co., Ltd., saponification value: 99, polymerization degree: 200, contact angle with water: 64°)), and 50 parts by weight of an ester-based nonionic surfactant (EMALEX TPM-320, manufactured by Nihon-Emulsion Co., Ltd., HLB: 9), at a processing amount on the base paper of 1 g/m$^2$ (provided amount of surfactant: 0.3 g/m$^2$), by using a laboratory size press manufactured by Kumagai Riki Kogyo Co., Ltd., and dried in KRK rotary dryer manufactured by Kumagai Riki Kogyo Co., Ltd. under the condition of 110° C. and 0.5 m/min, to give a recording paper (25) having a basis weight of 70 g/m$^2$.

<Recording Paper (26)>

Base papers having a basis weight of 69 g/m$^2$ prepared in a similar manner to recording paper (11) are size-pressed with a 5% by weight aqueous solution (surface sizing solution) containing surface sizing agents (100 parts by weight of an oxidized starch (Ace A, manufactured by Oji Cornstarch Co., contact angle with water: 39°)), and 40 parts by weight of an ester-based nonionic surfactant (EMALEX TSG-10, manufactured by Nihon-Emulsion Co., Ltd., HLB: 9), at a processing amount on the base paper of 1 g/m$^2$ (provided amount of surfactant: 0.3 g/m$^2$), by using a laboratory size press manufactured by Kumagai Riki Kogyo Co., Ltd., and dried in KRK rotary dryer manufactured by Kumagai Riki Kogyo Co., Ltd. under the condition of 110° C. and 0.5 m/min, to give a recording paper (26) having a basis weight of 70 g/m$^2$.

<Recording Paper (27)>

Base papers having a basis weight of 69 g/m$^2$ prepared in a similar manner to recording paper (11) are size-pressed with a 5% by weight aqueous solution (surface sizing solution) containing surface sizing agents (50 parts by weight of an oxidized starch (Ace A, manufactured by Oji Cornstarch Co., contact angle with water: 39°) and 50 parts by weight of polyvinyl alcohol (PVA102, manufactured by Kuraray Co., Ltd., saponification value: 99, polymerization degree: 200, contact angle with water: 64°)), and 50 parts by weight of an ester-based nonionic surfactant (EMALEX INTD-139, manufactured by Nihon-Emulsion Co., Ltd., HLB: 2), at a processing amount on the base paper of 1 g/m$^2$ (provided amount of surfactant: 0.3 g/m$^2$), by using a laboratory size press manufactured by Kumagai Riki Kogyo Co., Ltd., and dried in KRK rotary dryer manufactured by Kumagai Riki Kogyo Co., Ltd. under the condition of 110° C. and 0.5 m/min, to give a recording paper (27) having a basis weight of 70 g/m$^2$.

<Recording Paper (28)>

Base papers having a basis weight of 69 g/m$^2$ prepared in a similar manner to recording paper (11) are size-pressed with a 5% by weight aqueous solution (surface sizing solution) containing surface sizing agents (50 parts by weight of an oxidized starch (Ace A, manufactured by Oji Cornstarch Co., contact angle with water: 39°) and 50 parts by weight of polyvinyl alcohol (PVA102, manufactured by Kuraray Co., Ltd., saponification value: 99, polymerization degree: 200, contact angle with water: 64°)), at a processing amount on the base paper of 1 g/m$^2$, by using a laboratory size press manufactured by Kumagai Riki Kogyo Co., Ltd., and dried in KRK rotary dryer manufactured by Kumagai Riki Kogyo Co., Ltd. under the condition of 110° C. and 0.5 m/min, to give a recording paper (28) having a basis weight of 70 g/m$^2$.

The compositions and properties of the recording papers above are summarized in Table 1.

TABLE 1

| | Recording paper composition | | | | | | Recording paper properties | | |
|---|---|---|---|---|---|---|---|---|---|
| | Content of surface sizing agent | Surfactant | | | | | | | |
| | having a contact angle of 40 to 75° (weight %) | Structure | HLB | Content (parts by weight) | Provided amount (g/m$^2$) | Cationic material (g/m$^2$) | Surface resistivity (Ω/□)/volumetric resistivity (Ω · cm) | Stockigt sizing degree (S) | Formation index |
| Recording paper (1) | 100 | Ether-based | 8 | 16.6 | 0.14 | — | $1.0 \times 10^{10}/1.0 \times 10^{11}$ | 20 | 15 |
| Recording paper (2) | 100 | Ether-based | 13 | 16.6 | 0.14 | — | $1.0 \times 10^{10}/1.0 \times 10^{11}$ | 20 | 15 |
| Recording paper (3) | 100 | Ether-based | 8 | 5.0 | 0.10 | — | $1.0 \times 10^{10}/1.0 \times 10^{11}$ | 30 | 15 |
| Recording paper (4) | 100 | Ether-based | 8 | 1.0 | 0.02 | — | $1.0 \times 10^{10}/1.0 \times 10^{11}$ | 30 | 15 |
| Recording paper (5) | 100 | Ether-based | 8 | 28.6 | 0.11 | — | $1.0 \times 10^{10}/1.0 \times 10^{11}$ | 20 | 15 |
| Recording paper (6) | 0 | Ether-based | 8 | 16.6 | 0.14 | — | $1.0 \times 10^{10}/1.0 \times 10^{11}$ | 20 | 15 |
| Recording paper (7) | 100 | Ether-based | 17 | 16.6 | 0.14 | — | $1.0 \times 10^{10}/1.0 \times 10^{11}$ | 20 | 15 |
| Recording paper (8) | 100 | Ether-based | 4 | 16.6 | 0.14 | — | $1.0 \times 10^{10}/1.0 \times 10^{11}$ | 20 | 15 |
| Recording paper (9) | 100 | Ether-based | 8 | 0.05 | 0.005 | — | $1.0 \times 10^{10}/1.0 \times 10^{11}$ | 40 | 15 |
| Recording paper (10) | 0 | Ether-based | 8 | 16.6 | 0.14 | — | $1.0 \times 10^{10}/1.0 \times 10^{11}$ | 20 | 15 |
| Recording paper (11) | 50 | Ester-based | 8 | 50 | 0.3 | — | $1.0 \times 10^{10}/1.0 \times 10^{11}$ | 15 | 25 |
| Recording paper (12) | 50 | Ester-based | 10 | 50 | 0.3 | — | $8.0 \times 10^{9}/8.0 \times 10^{10}$ | 10 | 25 |
| Recording paper (13) | 50 | Ester-based | 6 | 50 | 0.3 | — | $2.0 \times 10^{10}/2.0 \times 10^{11}$ | 20 | 25 |
| Recording paper (14) | 18 | Ester-based | 8 | 82 | 0.1 | — | $4.0 \times 10^{10}/4.0 \times 10^{11}$ | 25 | 25 |

TABLE 1-continued

| | Recording paper composition | | | | | | | | |
|---|---|---|---|---|---|---|---|---|---|
| | Content of surface sizing agent | Surfactant | | | | | Recording paper properties | | |
| | having a contact angle of 40 to 75° (weight %) | Structure | HLB | Content (parts by weight) | Provided amount (g/m$^2$) | Cationic material (g/m$^2$) | Surface resistivity (Ω/□)/volumetric resistivity (Ω · cm) | Stockigt sizing degree (S) | Formation index |
| Recording paper (15) | 50 | Ester-based | 8 | 100 | 1.0 | — | $4.0 \times 10^9/4.0 \times 10^{10}$ | 5 | 25 |
| Recording paper (16) | 18 | Ester-based | 8 | 82 | 0.1 | — | $4.0 \times 10^{10}/4.0 \times 10^{11}$ | 30 | 20 |
| Recording paper (17) | 50 | Ester-based | 8 | 50 | 0.3 | — | $2.0 \times 10^9/2.0 \times 10^{10}$ | 3 | 25 |
| Recording paper (18) | 90 | Ester-based | 8 | 50 | 0.3 | — | $1.0 \times 10^{10}/1.0 \times 10^{11}$ | 15 | 25 |
| Recording paper (19) | 50 | Ester-based | 8 | 50 | 0.3 | — | $1.0 \times 10^{10}/1.0 \times 10^{11}$ | 15 | 25 |
| Recording paper (20) | 50 | Ester-based | 8 | 50 | 0.3 | — | $1.0 \times 10^{10}/1.0 \times 10^{11}$ | 15 | 25 |
| Recording paper (21) | 50 | Ester-based | 8 | 50 | 0.3 | — | $1.0 \times 10^{10}/1.0 \times 10^{11}$ | 15 | 25 |
| Recording paper (22) | 50 | Ester-based | 8 | 50 | 0.4 | 0.5 | $4.0 \times 10^9/4.0 \times 10^{10}$ | 5 | 25 |
| Recording paper (23) | 50 | Ester-based | 8 | 50 | 0.3 | — | $1.0 \times 10^{10}/1.0 \times 10^{11}$ | 15 | 15 |
| Recording paper (24) | 50 | Ester-based | 8 | 200 | 2.0 | — | $1.5 \times 10^9/1.5 \times 10^{10}$ | 1 | 25 |
| Recording paper (25) | 50 | Ether/ester-based | 8 | 50 | 0.3 | — | $1.0 \times 10^{10}/1.0 \times 10^{11}$ | 15 | 25 |
| Recording paper (26) | 0 | Ester-based | 8 | 40 | 0.3 | — | $2.0 \times 10^{10}/2.0 \times 10^{11}$ | 20 | 25 |
| Recording paper (27) | 50 | Ester-based | 2 | 50 | 0.3 | — | $4.0 \times 10^{10}/4.0 \times 10^{11}$ | 30 | 25 |
| Recording paper (28) | 50 | — | — | — | — | — | $1.5 \times 10^{11}/2.5 \times 10^{12}$ | 45 | 25 |

Examples 1 to 19, and Comparative Examples 1 to 10

Images are recorded both by the ink jet recording process and the electrophotographic process using the recording papers obtained above, and the properties of the recording papers are examined as follows: The recording papers and ink jet recording conditions employed in respective examples and comparative examples are summarized in Table 2.

(1) Evaluations by Ink Jet Recording Process

Evaluation of printed images is performed in an environment of 23° C. and 50% RH, and the images are printed by using a multi-path thermal ink jet recording device for evaluation equipped with four recording heads, which have a pitch of injecting nozzles of 800 dp, an number of injecting nozzles of 256, and an ejection amount of approximately 15 pl. The amounts of ink ejection are normally at two levels, 10 ml/m$^2$ and 7.5 ml/m$^2$. Further, the images are printed at a head scan speed of approximately 28 cm/sec on one face of the paper by batch printing.

Printed images are evaluated as follows:

—Evaluation of the Curl Immediately after Printing—

A 100% solid image is printed on a postcard-sized recording paper having 5-mm margins. The amount of the hanging curl generated on the opposite face of printed face immediately after printing is determined. The measured values are converted to and evaluated by curvatures. The evaluation criteria are as follows, and A and B indicate that the corresponding inks are on the allowable level.

A: Less than 20 m$^{-1}$.

B: 20 m$^{-1}$ or more and less than 35 m$^{-1}$.

C: 35 m$^{-1}$ or more and less than 50 m$^{-1}$.

D: 50 m$^{-1}$ or more.

—Evaluation of the Cockle Immediately after Printing—

A 2 cm×2 cm 100% solid image is printed at the center of a postcard-sized recording paper, and the maximum altitude of the resulting cockle generated immediately after printing is determined by a laser displacement meter. The evaluation criteria are as follows, and A and B indicate that the corresponding inks are on the allowable level.

A: Less than 1 mm.

B: 1 mm or more and less than 2 mm.

C: 2 mm or more and less than 3 mm.

D: 3 mm or more.

—Evaluation of the Curl after the Paper is Left to Dry—

A magenta 100% solid image is printed on a postcard-sized recording paper having 5-mm margins, and the paper is allowed to stand flat with the printed face facing upward under an environment of 23° C. and 50% RH for 100 hours after printing, and the amount of the hanging curl generated is determined. The measured values are converted to and evaluated by curvatures. The evaluation criteria are as follows, and A and B indicate that the corresponding inks are on the allowable level.

A: less than 30 m$^{-1}$.

B: 30 m$^{-1}$ or more and less than 75 m$^{-1}$.

D: 75 m$^{-1}$ or more.

—Evaluation of Image Quality—

100% yellow and 100% black images are printed next to each other on a postcard-sized recording paper, and the interface is evaluated according to the following criteria. B is on the allowable level.

B: No inter-color bleeding of image and fewer offset.

C: Some inter-color bleeding of image and slightly higher offset.

D: Inter-color bleeding of image or more offset.

The results are summarized in Table 2.

(2) Evaluation by Electrophotographic Process

Recording papers (1) to (10) are evaluated by using the DocuCentre Color400CP, manufactured by Fuji Xerox Co., Ltd. as the electronic photographic recording device as follows. A magenta 100% solid image is printed on a postcard-sized recording paper having 5-mm margins, and the amount of the hanging curl generated immediately after printing is determined. The measured values are converted to and evaluated by curvatures. The evaluation criteria are as follows, and A and B indicate that the corresponding inks are on the allowable level.

A: Less than 10 m$^{-1}$.

B: 10 m$^{1}$ or more and less than 20 m$^{-1}$.

C: 20 m$^{-1}$ or more and less than 35 m$^{-1}$.

D: 35 m$^{-1}$ or more.

In addition, recording papers (11) to (28) are evaluated by using the DocuPrint C3530 manufactured by Fuji Xerox Printing Systems Co., Ltd. as the electronic photographic recording device, as follows.

After images are formed by using a chart whereon a unicolor black image having a dots areal rate of 100% can be output and by using the recording papers above, unevenness in transferred toner images is evaluated visually according to the following criteria: B and B- are on the allowable level.

B: Extremely favorable as there is no unevenness in transferred toner images. Practically no problem.

B-: Almost no unevenness in transferred toner images. Practically no problem.

C: Slightly unfavorable as there is some unevenness in transferred toner images. Practically problemsome.

D: Unfavorable as there is much unevenness in transferred toner images. Practically problemsome.

The results are summarized in Table 2.

TABLE 2

| | Recording paper | Ink jet process: Ink No. | Ink ejection ($ml/m^2$) | Immediately after printing: Curl | Immediately after printing: Cockle | After the recording paper is left to dry: Curl | Image quality | Electrophotographic process Traveling property/ curl |
|---|---|---|---|---|---|---|---|---|
| Example 1 | (1) | Ink set 1 | 10 | A | A | A | B | A |
| Example 2 | (2) | Ink set 1 | 10 | A | A | A | B | B |
| Example 3 | (3) | Ink set 2 | 10 | A | A | A | C | B |
| Example 4 | (4) | Ink set 2 | 10 | B | B | B | B | B– |
| Example 5 | (5) | Ink set 1 | 10 | A | A | A | B | B |
| Example 6 | (11) | Ink set 1 | 10 | A | A | A | B | B |
| Example 7 | (12) | Ink set 1 | 10 | A | A | A | B | B |
| Example 8 | (13) | Ink set 1 | 10 | A | A | A | B | B |
| Example 9 | (14) | Ink set 1 | 10 | A | A | A | B | B– |
| Example 10 | (15) | Ink set 1 | 10 | A | A | A | B | B |
| Example 11 | (16) | Ink set 1 | 10 | A | A | A | B | B– |
| Example 12 | (17) | Ink set 1 | 10 | A | A | A | B | B |
| Example 13 | (18) | Ink set 1 | 10 | A | A | A | B | B |
| Example 14 | (19) | Ink set 1 | 10 | A | A | A | B | B |
| Example 15 | (20) | Ink set 1 | 10 | A | A | A | B | B |
| Example 16 | (21) | Ink set 1 | 10 | A | A | A | B | B |
| Example 17 | (22) | Ink set 1 | 10 | A | A | A | B | B |
| Example 18 | (23) | Ink set 1 | 10 | A | A | A | B | B– |
| Example 19 | (11) | Ink set 1 | 7.5 | A | A | A | B | B |
| Comparative Example 1 | (6) | Ink set 1 | 10 | D | D | D | B | D |
| Comparative Example 2 | (7) | Ink set 1 | 10 | D | D | D | B | D |
| Comparative Example 3 | (8) | Ink set 2 | 10 | D | D | D | B | D |
| Comparative Example 4 | (9) | Ink set 2 | 10 | D | D | D | B | D |
| Comparative Example 5 | (10) | Ink set 2 | 10 | D | D | D | B | D |
| Comparative Example 6 | (24) | Ink set 1 | 10 | B | B | B | C | B– |
| Comparative Example 7 | (25) | Ink set 1 | 10 | B | B | B | B | C |
| Comparative Example 8 | (26) | Ink set 1 | 10 | D | D | D | C | B– |
| Comparative Example 9 | (27) | Ink set 1 | 10 | C | C | C | B | B– |
| Comparative Example 10 | (28) | Ink set 1 | 10 | D | D | D | D | C |

As apparent from Table 2, the recording papers according to the invention used in examples are excellent in providing high quality images without the incidence of the curl and cockle after printing both in the ink jet recording process and the electrophotographic process. In contrast, the recording papers of comparative examples lead to a problem such as curl after printing, deterioration in image quality, improper traveling in machine, or the like.

2. Examples Using Second Recording Paper (1) Preparation of Inks

In a similar manner to the examples of the first recording paper, dye-based ink set 1 and pigment-based ink set 2 are prepared. The conditions for measuring the physical properties of inks are the same as those described in the examples of the first recording papers.

(2) Preparation of Recording Papers

Following recording papers (2-1) to (2-11) are prepared.

<Recording Paper (2-1)>

Green 100 Papers manufactured by Fuji Xerox Office Supply Co., Ltd. (recycled wood-containing paper) are size-pressed with a 5% by weight aqueous solution (surface sizing solution) containing a surface sizing agent (an oxidized starch, Ace A, manufactured by Oji Cornstarch Co., Ltd.), 17% by weight of a nonionic surfactant (Surfynol 440, manufactured by Nisshin Chemical Industry Co., Ltd., HLB: 8) with respect to the weight of the surface sizing agent, and 17% by weight of a cationic surfactant (Quartamine 86P Conc, manufactured by Kao Corporation) with respect to the weight of the surface sizing agent on the surface of paper at a processing amount on paper of 2.0 g/m$^2$ as dry weight, by using a laboratory size press manufactured by Kumagai Riki Kogyo Co., Ltd., and dried in KRK rotary dryer manufactured by Kumagai Riki Kogyo Co., Ltd. under the condition of 110° C. and 0.5 m/min, to give a recording paper (2-1) having a basis weight of 70 g/m$^2$.

<Recording Paper (2-2)>

Green 100 Papers manufactured by Fuji Xerox Office Supply Co., Ltd. (recycled wood-containing paper) are size-pressed with a 5% by weight aqueous solution (surface sizing solution) containing a surface sizing agent (an oxidized starch, Ace A, manufactured by Oji Cornstarch Co., Ltd.), 29% by weight of a nonionic surfactant (EMALEX 603, manufactured by Nihon-Emulsion Co., Ltd., HLB: 6) with respect to the weight of the surface sizing agent, and 29% by weight of a cationic surfactant (Quartamine 86P Conc, manufactured by Kao Corporation) with respect to the weight of the surface sizing agent on the surface of paper at a processing amount on paper of 2.0 g/m$^2$ as dry weight, by using a laboratory size press manufactured by Kumagai Riki Kogyo Co., Ltd., and dried in KRK rotary dryer manufactured by Kumagai Riki Kogyo Co., Ltd. under the condition of 110° C. and 0.5 m/min, to give a recording paper (2-2) having a basis weight of 70 g/m$^2$.

<Recording Paper (2-3)>

Green 100 Papers manufactured by Fuji Xerox Office Supply Co., Ltd. (recycled wood-containing paper) are size-pressed with a 5% by weight aqueous solution (surface sizing solution) containing a surface sizing agent (an oxidized starch, Ace A, manufactured by Oji Cornstarch Co., Ltd.), 17% by weight of a nonionic surfactant (Surfynol 465, manufactured by Nisshin Chemical Industry Co., Ltd., HLB: 13) with respect to the weight of the surface sizing agent, and 9% by weight of a cationic surfactant (Quartamine 86P Conc, manufactured by Kao Corporation) with respect to the weight of the surface sizing agent on the surface of paper at a processing amount on paper of 1.0 g/m$^2$ as dry weight, by using a laboratory size press manufactured by Kumagai Riki Kogyo Co., Ltd., and dried in KRK rotary dryer manufactured by Kumagai Riki Kogyo Co., Ltd. under the condition of 110° C. and 0.5 m/min, to give a recording paper (2-3) having a basis weight of 69 g/m$^2$.

<Recording Paper (2-4)>

Green 100 Papers manufactured by Fuji Xerox Office Supply Co., Ltd. (recycled wood-containing paper) are size-pressed with a 5% by weight aqueous solution (surface sizing solution) containing a surface sizing agent (an oxidized starch, Ace A, manufactured by Oji Cornstarch Co., Ltd.), 17% by weight of a nonionic surfactant (Surfynol 440, manufactured by Nisshin Chemical Industry Co., Ltd., HLB: 8) with respect to the weight of the surface sizing agent, and 17% by weight of a cationic surfactant (Quartamine 86P Conc, manufactured by Kao Corporation) with respect to the weight of the surface sizing agent on the surface of paper at a processing amount on paper of 0.1 g/m$^2$ as dry weight, by using a laboratory size press manufactured by Kumagai Riki Kogyo Co., Ltd., and dried in KRK rotary dryer manufactured by Kumagai Riki Kogyo Co., Ltd. under the condition of 110° C. and 0.5 m/min, to give a recording paper (2-4) having a basis weight of 68 g/m$^2$.

<Recording Paper (2-5)>

Green 100 Papers manufactured by Fuji Xerox Office Supply Co., Ltd. (recycled wood-containing paper) are size-pressed with a 5% by weight aqueous solution (surface sizing solution) containing a surface sizing agent (an oxidized starch, Ace A, manufactured by Oji Cornstarch Co., Ltd.), 10% by weight of a nonionic surfactant (Surfynol 440, manufactured by Nisshin Chemical Industry Co., Ltd., HLB: 8) with respect to the weight of the surface sizing agent, and 10% by weight of a cationic surfactant (Quartamine 86P Conc, manufactured by Kao Corporation) with respect to the weight of the surface sizing agent on the surface of paper at a processing amount on paper of 0.5 g/m$^2$ as dry weight, by using a laboratory size press manufactured by Kumagai Riki Kogyo Co., Ltd., and dried in KRK rotary dryer manufactured by Kumagai Riki Kogyo Co., Ltd. under the condition of 110° C. and 0.5 m/min, to give a recording paper (2-5) having a basis weight of 69 g/m$^2$.

<Recording Paper (2-6)>

Green 100 Papers manufactured by Fuji Xerox Office Supply Co., Ltd. (recycled wood-containing paper) are size-pressed with a 5% by weight aqueous solution (surface sizing solution) containing a surface sizing agent (an oxidized starch, Ace A, manufactured by Oji Cornstarch Co., Ltd.), 50% by weight of a nonionic surfactant (Surfynol 440, manufactured by Nisshin Chemical Industry Co., Ltd., HLB: 8) with respect to the weight of the surface sizing agent, and 50% by weight of a cationic surfactant (Quartamine 86P Conc, manufactured by Kao Corporation) with respect to the weight of the surface sizing agent on the surface of paper at a processing amount on paper of 1.0 g/m$^2$ as dry weight, by using a laboratory size press manufactured by Kumagai Riki Kogyo Co., Ltd., and dried in KRK rotary dryer manufactured by Kumagai Riki Kogyo Co., Ltd. under the condition of 110° C. and 0.5 m/min, to give a recording paper (2-6) having a basis weight of 69 g/m$^2$.

<Recording Paper (2-7)>

Green 100 Papers manufactured by Fuji Xerox Office Supply Co., Ltd. (recycled wood-containing paper) are size-pressed with a 5% by weight aqueous solution (surface sizing solution) containing a surface sizing agent (an oxidized starch, Ace A, manufactured by Oji Cornstarch Co., Ltd.), 17% by weight of a nonionic surfactant (Surfynol 420, manufactured by Nisshin Chemical Industry Co., Ltd., HLB: 4) with respect to the weight of the surface sizing agent, and 17% by weight of a cationic surfactant (Quartamine 86P Conc, manufactured by Kao Corporation) with respect to the weight of the surface sizing agent on the surface of paper at a processing amount on paper of 2.0 g/m$^2$ as dry weight, by using a laboratory size press manufactured by Kumagai Riki Kogyo Co., Ltd., and dried in KRK rotary dryer manufactured by Kumagai Riki Kogyo Co., Ltd. under the condition of 110° C. and 0.5 m/min, to give a recording paper (2-7) having a basis weight of 70 g/m$^2$.

<Recording Paper (2-8)>

Green 100 Papers manufactured by Fuji Xerox Office Supply Co., Ltd. (recycled wood-containing paper) are size-pressed with a 5% by weight aqueous solution (surface sizing solution) containing a surface sizing agent (an oxidized starch, Ace A, manufactured by Oji Cornstarch Co., Ltd.), 17% by weight of a nonionic surfactant (Surfynol 485, manufactured by Nisshin Chemical Industry Co., Ltd., HLB: 17) with respect to the weight of the surface sizing agent, and 17% by weight of a cationic surfactant (Quartamine 86P Conc, manufactured by Kao Corporation) with respect to the weight of the surface sizing agent on the surface of paper at a processing amount on paper of 2.0 g/m$^2$ as dry weight, by using a laboratory size press manufactured by Kumagai Riki Kogyo Co., Ltd., and dried in KRK rotary dryer manufactured by Kumagai Riki Kogyo Co., Ltd. under the condition of 110° C. and 0.5 m/min, to give a recording paper (2-8) having a basis weight of 70 g/m$^2$.

<Recording Paper (2-9)>

Green 100 Papers manufactured by Fuji Xerox Office Supply Co., Ltd. (recycled wood-containing paper) are size-pressed with a 5% by weight aqueous solution (surface sizing solution) containing a surface sizing agent (an oxidized starch, Ace A, manufactured by Oji Cornstarch Co., Ltd.), 17% by weight of a nonionic surfactant (Surfynol 440, manufactured by Nisshin Chemical Industry Co., Ltd., HLB: 8) with respect to the weight of the surface sizing agent, and 5% by weight of a cationic surfactant (Quartamine 86P Conc, manufactured by Kao Corporation) with respect to the weight of the surface sizing agent on the surface of paper at a processing amount on paper of 2.0 g/m$^2$ as dry weight, by using a laboratory size press manufactured by Kumagai Riki Kogyo Co., Ltd., and dried in KRK rotary dryer manufactured by Kumagai Riki Kogyo Co., Ltd. under the condition of 110° C. and 0.5 m/min, to give a recording paper (2-9) having a basis weight of 70 g/m$^2$.

<Recording Paper (2-10)>

Green 100 Papers manufactured by Fuji Xerox Office Supply Co., Ltd. (recycled wood-containing paper) are size-pressed with a 5% by weight aqueous solution (surface sizing solution) containing a surface sizing agent (an oxidized starch, Ace A, manufactured by Oji Cornstarch Co., Ltd.), 17% by weight of a nonionic surfactant (manufactured by Nisshin Chemical Industry Co., Ltd., Surfynol 440, HLB: 8) with respect to the weight of the surface sizing agent, and 9% by weight of a cationic surfactant (Quartamine 86P Conc, manufactured by Kao Corporation) with respect to the weight of the surface sizing agent on the surface of paper at a processing amount on paper of 3.0 g/m$^2$ as dry weight, by using a laboratory size press manufactured by Kumagai Riki Kogyo Co., Ltd., and dried in KRK rotary dryer manufactured by Kumagai Riki Kogyo Co., Ltd. under the condition of 110° C. and 0.5 m/min, to give a recording paper (2-10) having a basis weight of 71 g/m$^2$.

<Recording Paper (2-11)>

Green 100 Papers manufactured by Fuji Xerox Office Supply Co., Ltd. (recycled wood-containing paper) are size-pressed with a 5% by weight aqueous solution (surface sizing solution) containing a surface sizing agent (an oxidized starch, Ace A, manufactured by Oji Cornstarch Co., Ltd.), 17% by weight of a nonionic surfactant (Surfynol 440, manufactured by Nisshin Chemical Industry Co., Ltd., HLB: 8) with respect to the weight of the surface sizing agent, and 9% by weight of a cationic surfactant (Quartamine 86P Conc, manufactured by Kao Corporation) with respect to the weight of the surface sizing agent on the surface of paper at a processing amount on paper of 0.05 g/m$^2$ as dry weight, by using a laboratory size press manufactured by Kumagai Riki Kogyo Co., Ltd., and dried in KRK rotary dryer manufactured by Kumagai Riki Kogyo Co., Ltd. under the condition of 110° C. and 0.5 m/min, to give a recording paper (2-11) having a basis weight of 68 g/m$^2$.

Examples 2-1 to 2-6, and Comparative Examples 2-1 to 2-5

The inks and recording papers prepared as described above are evaluated in the combinations shown in Table 3.

TABLE 3

| | Recording paper | | | | | | Evaluation result | | | |
|---|---|---|---|---|---|---|---|---|---|---|
| | | | | | | Dry weight | Ink jet recording process | | | |
| | Ink No. | Preparation No. | HLB of nonionic surfactant | Content of nonionic surfactant (to surface sizing agent) (weight %) | Content cationic surfactant (to surface sizing agent) (weight %) | of surface sizing solution (g/m$^2$) (g/m$^2$) | Immediately after printing Curl | Immediately after printing Cockle | After the recording paper is left to dry Curl | Electrophotographic process Immediately after printing Curl |
| Example 2-1 | Ink set 1 | Recording paper 2-1 | 8 | 17 | 17 | 2.0 | a | a | a | a |
| Example 2-2 | Ink set 2 | Recording paper 2-2 | 6 | 29 | 29 | 2.0 | a | a | a | a |
| Example 2-3 | Ink set 2 | Recording paper 2-3 | 13 | 17 | 9 | 1.0 | a | b | b | a |
| Example 2-4 | Ink set 2 | Recording paper 2-4 | 8 | 17 | 17 | 0.1 | b | b | b | b |
| Example 2-5 | Ink set 1 | Recording paper 2-5 | 8 | 10 | 10 | 0.5 | b | b | b | b |
| Example 2-6 | Ink set 1 | Recording paper 2-6 | 8 | 50 | 50 | 1.0 | a | a | a | a |
| Comparative Example 2-1 | Ink set 2 | Recording paper 2-7 | 4 | 17 | 17 | 2 | c | b | c | c |
| Comparative Example 2-2 | Ink set 2 | Recording paper 2-8 | 17 | 17 | 17 | 2 | c | c | c | c |
| Comparative Example 2-3 | Ink set 2 | Recording paper 2-9 | 8 | 17 | 5 | 2 | c | b | c | c |
| Comparative Example 2-4 | Ink set 2 | Recording paper 2-10 | 8 | 17 | 9 | 3 | c | c | b | c |
| Comparative Example 2-5 | Ink set 1 | Recording paper 2-11 | 8 | 17 | 9 | 0.05 | c | c | c | c |

(1) Evaluation by Ink Jet Recording Process

Evaluation of printed images is performed in an environment of 23° C. and 50% RH, and the images are printed by using a multi-path thermal ink jet recording device for evaluation equipped with four recording heads, which have a pitch of injecting nozzles of 800 dp, an number of injecting nozzles of 256, and an ejection amount of approximately 15 pl, an amount of ink ejection of approximately 10 ml/m$^2$, and a head scan speed of approximately 280 mm/sec. The images are printed on one face of paper by batch printing.

The papers after printing are evaluated as follows:

—Evaluation of the Curl Immediately after Printing—

A magenta 100% solid image is printed on a postcard-sized recording paper having 5-mm margins, and the amount of the hanging curl generated immediately after printing is determined. The measured values are converted to and evaluated by curvatures. The evaluation criteria are as follows, and a and b indicate that the corresponding inks are on the allowable level. The evaluation results are summarized in Table 1.

a: Less than 20 m$^{-1}$. Small curl curvature, no problem.

b: 20 m$^{-1}$ or more and less than 50 m$^{-1}$. Curl curvature larger but in the allowable range.

c: 50 m$^{-1}$ or more. Curl curvature larger, and practically troublesome.

—Evaluation of the Cockle Immediately after Printing—

A 2 cm×2 cm 100% solid image is printed at the center of a postcard-sized recording paper, and the maximum altitude of the resulting cockle generated immediately after printing is determined by a laser displacement meter (LK-030, manufactured by Keyence Corp.). The evaluation criteria are as follows, and a and b indicate that the corresponding inks are on the allowable level. The evaluation results are summarized in Table 1.

a: Less than 1 mm. Low cockle altitude, no problem.

b: 1 mm or more and less than 2 mm. Cockle altitude slightly higher, but in the allowable range.

c: 2 mm or more. Cockle altitude higher, and problemsome.

—Evaluation of the Curl after the Recording Paper is Left to Dry—

A 100% solid image is printed on a postcard-sized recording paper having 5-mm margins, and the paper is allowed to stand flat with the printed face facing upward under an environment of 23° C. and 50% RH for 100 hours after printing, and the amount of the hanging curl generated is determined. The measured values are converted to and evaluated by curl curvatures. The evaluation criteria are as follows, and a and b indicate that the corresponding inks are on the allowable level. The evaluation results are summarized in Table 1.

a: Less than 30 m$^{-1}$. Curl curvature small and no problem.

b: 30 m$^{-1}$ or more and less than 75 m$^{-1}$. Curl curvature slightly larger but in the allowable range.

c: 75 m$^{-1}$ or more. Curl curvature larger and practically problemsome.

The results are summarized in Table 2.

(2) Evaluation by Electrophotographic Process

Following evaluations are performed by using the DocuCentre Color400CP, manufactured by Fuji Xerox Co., Ltd., as the electronic photographic recording device.

—Evaluation of the Curl Immediately after Printing—

A magenta 100% solid image is printed on a postcard-sized recording paper having 5-mm margins, and the amount of the hanging curl generated immediately after printing is determined. The measured values are converted to and evaluated by curvatures. The evaluation criteria are as follows, and a and b indicate that the corresponding inks are on the allowable level. The evaluation results are summarized in Table 1.

The electrophotographic image recording process comprises charging, exposing, developing, transferring, and fixing steps.

a: Less than 10 m$^{-1}$. Curl curvature small and no problem.

b: 10 m$^{-1}$ or more and less than 35 m$^{-1}$. Curl curvature slightly larger but in the allowable range.

c: 35 m$^{-1}$ or more. Curl curvature larger and practically problemsome.

As apparent from Table 3 above, the recording papers of examples 2-1 to 2-6 (the recording papers according to the invention) have fewer incidence of the curl and cockle that occur immediately after printing and of the curl after the recording paper is left to dry, both in the ink jet recording process and the electrophotographic recording process.

In contrast, the recording papers of comparative examples 2-1 to 2-5 lead to a practical problem either in the curl or cockle that occurs immediately after printing or in the curl after the recording paper is left to dry, independent of the recording methods of ink jet process or electrophotographic process.

The invention provides a recording paper usable both in ink jet and electrophotographic recording processes, that allows improvement in image quality on document, enables printing of images on both faces of papers by suppressing generation of the curl and cockle immediately after printing, and prevents the curl and cockle generated after the recording paper is left to dry when used in the ink jet recording process, and avoids the inadequate image transfer when images are formed in the electrophotographic process, and an image recording method using the same.

What is claimed is:

1. A recording paper comprising a substrate which comprises cellulose pulp, said substrate having a surface treated with a surface sizing solution, wherein the surface sizing solution contains a surface sizing agent and a nonionic surfactant having an HLB in a range of 6 to 13;

a content of the nonionic surfactant is in a range of 1 to 100 parts by weight per 100 parts by weight of the surface sizing agent; and the surface sizing agent has a contact angle with water in a range of 40 to 75°.

2. The recording paper according to claim 1, wherein the surface sizing solution contains the surface sizing agent having a contact angle with water in a range of 40 to 75° in an amount of 5% by weight or more relative to a total amount of surface sizing agents.

3. The recording paper according to claim 1, wherein the nonionic surfactant is an ester-based nonionic surfactant.

4. The recording paper according to claim 3, wherein the ester-based nonionic surfactant is selected from a sorbitan fatty acid ester, a glycerin monofatty acid ester, a polyoxyethylene hydrogenated castor oil fatty acid ester, or a polyglycerin fatty acid ester.

5. The recording paper according to claim 3, wherein the ester-based nonionic surfactant has an HLB of 6 or more and less than 11.

6. The recording paper according to claim 3, wherein an amount of the ester-based nonionic surfactant provided after a surface treatment is in a range of 0.02 to 1.0 g/m$^2$.

7. The recording paper according to claim 1, having a Stockigt sizing degree in a range of 1 to 30 seconds for a sheet having a basis weight of 70 $g/m^2$.

8. The recording paper according to claim 1, wherein the surface sizing agent having a contact angle with water in a range of 40 to 75° is polyvinyl alcohol.

9. The recording paper according to claim 8, wherein a polymerization degree of the polyvinyl alcohol is in a range of 100 to 1,500.

10. The recording paper according to claim 1, having a basis weight in a range of 60 to 128 $g/m^2$.

11. The recording paper according to claim 1, wherein a fiber orientation ratio thereof is in a range of 1.0 to 1.55.

12. The recording paper according to claim 1, further comprising at least one of a cationic resin and a polyvalent metal salt on the surface.

13. The recording paper according to claim 12, wherein a content of the at least one of a cationic resin and a polyvalent metal salt on the recording paper surface is in a range of 0.1 to 2 $g/m^2$.

14. The recording paper according to claim 1, having a formation index in a range of 10 to 50.

15. The recording paper according to claim 1, wherein a surface resistivity of at least a face thereof to be printed on is in a range of $1.0\times10^9$ to $1.0\times10^{11}$ Ω/□.

16. The recording paper according to claim 1, wherein a volumetric resistivity of at least a face thereof to be printed on is in a range of $1.3\times10^{10}$ to $1.6\times10^{11}$ Ω·cm.

17. An image recording method using an ink jet recording process comprising ejecting an ink droplet onto a recording paper to record an image on a surface thereof, wherein the recording paper is the recording paper according to claim 1.

18. The image recording method according to claim 17, wherein the ink comprises a colorant, an anionic compound, and a water-soluble organic solvent.

19. An image recording method using an electrophotographic process comprising charging an electrostatic latent image holding member surface, exposing the electrostatic latent image holding member surface to light to form an electrostatic latent image thereon, developing the electrostatic latent image formed on the electrostatic latent image holding member surface by using a developer to form a toner image, transferring the toner image onto a surface of a recording paper, and fixing the toner image thereon, wherein the recording paper is the recording paper according to claim 1.

20. The image recording method according to claim 19, wherein a surface resistivity of at least a face, of the recording paper, to be printed on is in a range of $1.0\times10^9$ to $1.0\times10^{11}$ Ω/□, and a volumetric resistivity thereof is in a range of $1.3\times10^{10}$ to $1.6\times10^{11}$ Ω·cm.

* * * * *